US009187889B2

(12) United States Patent
Juhere et al.

(10) Patent No.: US 9,187,889 B2
(45) Date of Patent: Nov. 17, 2015

(54) TANK WITH A TILTING BUCKET

(75) Inventors: Yannick Juhere, Cancale (FR); Jean-Pierre Dautais, Basse Goulaine (FR)

(73) Assignees: MAYA GROUP, Chateauneuf d'Ille et Vilaine (FR); PREMIER TECH TECHNOLOGIES, Quebec (CA)

( * ) Notice: Subject to any disclaimer, the term of this patent is extended or adjusted under 35 U.S.C. 154(b) by 1107 days.

(21) Appl. No.: 13/254,425

(22) PCT Filed: Mar. 2, 2010

(86) PCT No.: PCT/EP2010/052637

§ 371 (c)(1),
(2), (4) Date: Nov. 21, 2011

(87) PCT Pub. No.: WO2010/100161

PCT Pub. Date: Sep. 10, 2010

(65) Prior Publication Data

US 2012/0061406 A1 Mar. 15, 2012

(30) Foreign Application Priority Data

Mar. 3, 2009 (FR) ..... 09 51334

(51) Int. Cl.
*B65D 25/06* (2006.01)
*E03F 5/10* (2006.01)
*B65D 6/40* (2006.01)

(52) U.S. Cl.
CPC ..... *E03F 5/107* (2013.01); *E03F 2201/30* (2013.01)

(58) Field of Classification Search
CPC ..... E03F 5/107; E03F 9/007; E03D 1/20
USPC ..... 220/628, 501, 601; 137/204, 401, 403, 137/546, 544, 581
See application file for complete search history.

(56) References Cited

U.S. PATENT DOCUMENTS 228,264 A * 6/1880 Macfarland ..... 137/396
4,756,827 A * 7/1988 Mayer ..... 405/40

(Continued)

FOREIGN PATENT DOCUMENTS

FR 2 872 183 12/2005
FR 2 874 945 3/2006
WO WO 2008/064420 6/2008

OTHER PUBLICATIONS

International Search Report for PCT/EP2010/052637, mailed Jun. 22, 2010.

(Continued)

*Primary Examiner* — Mickey Yu
*Assistant Examiner* — Niki Eloshway
(74) *Attorney, Agent, or Firm* — Nixon & Vanderhye, PC

(57) ABSTRACT

The invention relates to a tank (100) provided with at least one effluent-filling opening and at least two effluent-emptying openings, a bucket capable of tilting between a filling position, in which it can be filled with an incoming effluent through said at least one filling opening, and a discharge position, in which it can discharge the contents thereof through one or more of said emptying openings. According to the invention, the tank (100) includes means for modifying the position of the bucket (200, 200') so as to change the direction thereof or to enable the replacement thereof with another bucket of a different type.

Figure 1:
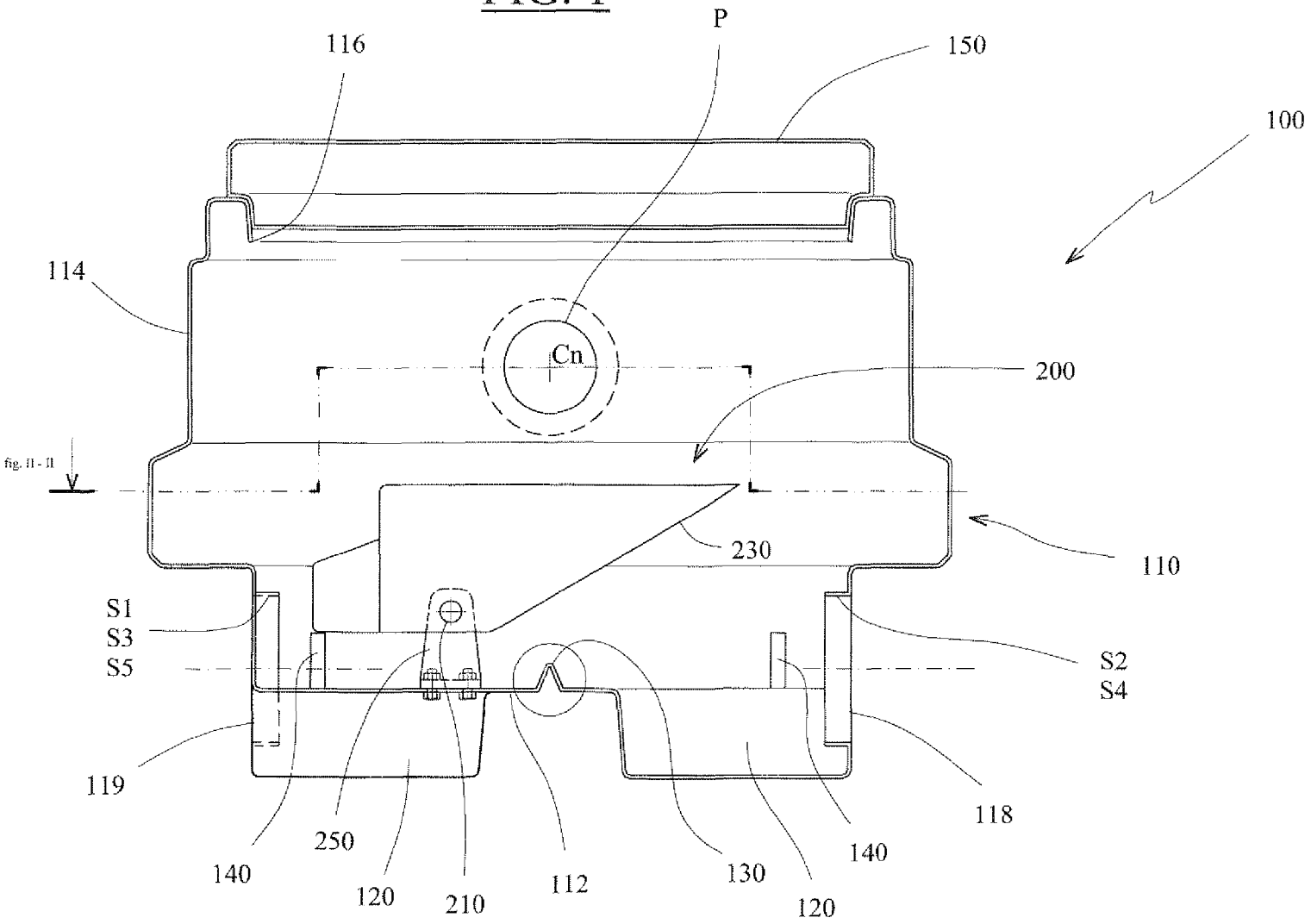

It is thus possible to modify the effluent outlet direction by a simple change in the bucket position. It is also possible to replace a bucket with a bucket of a different type.

In this way greater versatility of the adaptation to the connection of the tank on the installation site is afforded.

25 Claims, 26 Drawing Sheets

(56) References Cited

U.S. PATENT DOCUMENTS

| | | | | |
|---|---|---|---|---|
| 5,645,732 | A * | 7/1997 | Daniels | 210/747.1 |
| 5,666,674 | A * | 9/1997 | Hennessy | 4/365 |
| 6,611,967 | B1 * | 9/2003 | Hennessy et al. | 4/365 |
| 7,837,867 | B2 * | 11/2010 | McKinney | 210/101 |
| 2010/0032032 | A1 * | 2/2010 | Davenport et al. | 137/581 |
| 2010/0126941 | A1 * | 5/2010 | Stiles | 210/747 |
| 2011/0099702 | A1 * | 5/2011 | Bevan et al. | 4/353 |

OTHER PUBLICATIONS

Foreign-language Written Opinion of the International Searching Authority for PCT/EP2010/052637, mailed Jun. 22, 2010.

* cited by examiner

FIG. 9
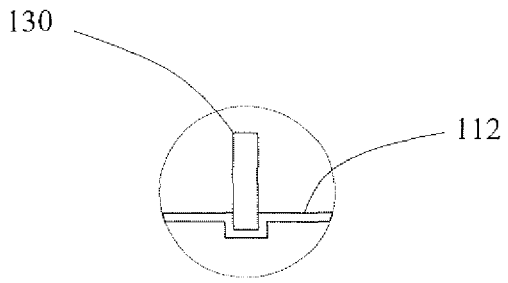
FIG. 10b
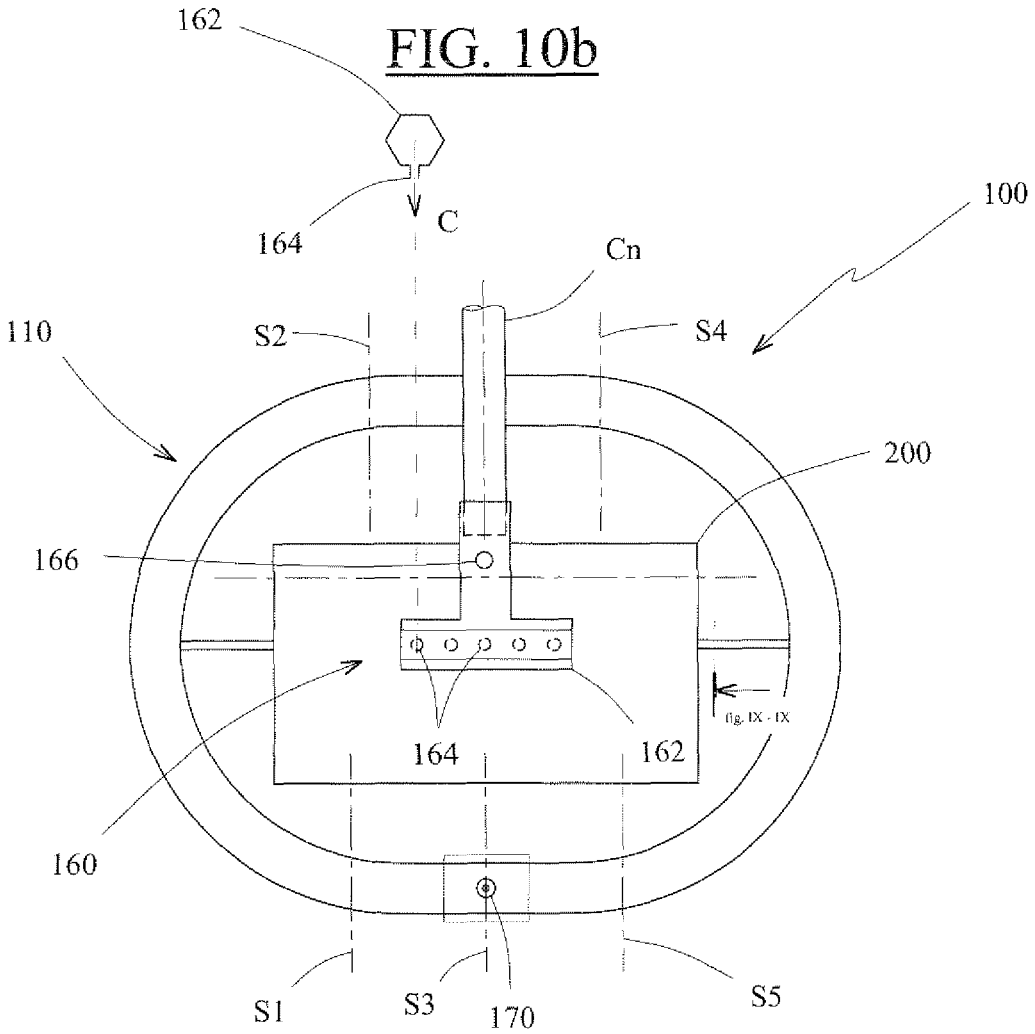
FIG. 10a

TANK WITH A TILTING BUCKET

This application is the U.S. national phase of International Application No. PCT/EP2010/052637, filed 2 Mar. 2010, which designated the U.S., and claims priority to FR Application No. 09/51334, filed 3 Mar. 2009, the entire contents of which is hereby incorporated by reference.

The present invention concerns a tank with a bucket intended for distributing an effluent from an effluent source, for example settled waste water, and modifying the distribution of such an effluent.

This invention finds an application in the field of manuring, and in particular in the field of underground manuring, the field of infiltration in the soil through trenches, effluent treatment or the irrigation of plant beds, or the supply of effluent treatment systems in a battery.

In order to infiltrate the soil using an effluent, for example issuing from the treatment of waste water, it is possible to use drains that are distributed over the surface to be irrigated. These drains are connected to the effluent supply pipe. When the flow rate of effluent is insufficient for irrigating the drained surface, it is possible to use a distribution box as presented in the U.S. Pat. No. 4,838,731.

Such a box comprises an effluent inlet and at least one outlet for the effluent and incorporates a bucket mounted for pivoting between a filling position in which it can be filled by the incoming effluent and an emptying position into which it is tilted in order to quickly empty its content at the end of filling thereof in the effluent outlet or outlets. The bucket is provided with a counterweight in order to return it to its filling position when it is empty. Stops limit the travel of the bucket in its two noteworthy positions.

Having regard to the great diversity of the possible installation configurations and the great variability of the hydraulic regime of a tank of this type, the applicant has sought a solution for adapting such a tank to the most diverse installation conditions.

To this end, a tank is proposed provided with at least one opening for filling with an effluent and at least two openings for emptying the effluent, and a bucket of the type mounted for tilting between a filling position in which it can be filled by an incoming effluent through said or each filling opening and a discharge position in which it can discharge its content through said or each emptying opening; the tank according to the invention comprising means designed to modify the position of the bucket so as to change the discharge direction thereof or to enable it to be replaced by another bucket of a different type.

It is thus possible to modify the outlet direction of the effluent by simple change in the position of the bucket. It can also be replaced by another bucket of a different type. In this way greater flexibility of adaptation to the connection of the tank on the installation site is afforded.

According to an additional feature of the invention, the tank comprises a casing and the bucket is mounted so as to be articulated in the casing, by means of two shafts held in respectively two bearings secured to said casing, the bearings being removable or in sufficient number to modify the position of the bucket.

By placing the bearings at other points or by mounting the shafts in other bearings, it is possible in this way to position the bucket in another location.

According to an additional feature of the invention, each bearing is secured by bolts passing through holes produced through a bottom wall constituting the casing, the holes delimiting the locations in which said bearings are installed.

By moving the bearings and reversing the bucket, the arrangement of the bucket is modified in order to adapt the tank to a different distribution configuration.

According to an additional feature of the invention, the bucket is of the unilateral discharge type and comprises a volume for storing the effluent, and a counterweight, the bucket being able to move between a filling position and a discharge position, the storage volume and the counterweight being arranged so that the centre of gravity of the bucket can, during the filling of the storage volume, pass through a vertical plane passing through the articulation axis of the bucket so as to cause it to tilt towards its discharge position.

The tank with bucket thus makes it possible to deliver, cyclically and abruptly, the whole of the effluent stored in the bucket, through the emptying opening or openings. It is possible in this way to supply deeply a drainage device capable of being connected to said or each emptying opening.

According to an additional feature of the invention, the bucket is of the bilateral discharge type and comprises, in a variant embodiment, not one but two storage volumes for the effluent disposed on either side of an intermediate wall, the bucket being able to move alternately between two discharge positions, the filling position of a storage volume also being a discharge position for the other storage volume, the centre of gravity of the bucket being placed so that it can, during the filling of a storage volume, pass through a vertical plane passing through the articulation axis of the bucket so as to cause it to tilt towards its other discharge position.

There also, when the centre of gravity of the bucket passes through this vertical plane, it tilts, abruptly discharging its content towards the corresponding discharge openings.

This bidirectional-discharge bucket procures greater flexibility in use for the tank, enabling it to distribute an effluent alternately in two directions.

According to an additional feature of the invention, the two storage volumes have different capacities in order to discharge a greater quantity of effluent on one side of the tank rather than on the other.

According to an additional feature of the invention, the emptying openings emerge respectively in vessels formed recessed in the bottom wall of the casing.

These vessels form a temporary reservoir enabling the effluent to flow through emptying openings at the end of the discharge of the bucket.

According to an additional feature of the invention, passages connect the communicating vessels with the emptying openings situated on the same side, with the vessels communicating with the emptying openings situated on the opposite side, so that the bucket can discharge its content through all the emptying openings that are open.

According to an additional feature of the invention, a wall forming a barrage separates the bottom wall between the two rows of emptying openings in order to contain the effluent discharged so that it flows solely into the vessels in the row situated on the discharge side of the bucket.

In this way increased precision is obtained with regard to the quantity of effluent discharged through the emptying openings each time the bucket is tilted.

According to an additional feature of the invention, at least one stop is disposed in the bottom wall for limiting the tilting of the bucket in its filling position or positions.

According to an additional feature of the invention, at least one mask is placed in the bucket facing a corresponding emptying opening closed by an obturator in order to preserve distribution distributed in a balanced manner between the other emptying openings.

According to an additional feature of the invention, the width of the bucket is small so that it does not discharge its content in the direction of a closed emptying opening or openings.

According to an additional feature of the invention, a flow-rate sensor is installed on an effluent supply pipe intended to be mounted through the filling opening, or a meter is installed on the bucket, in order to know or calculate the quantity of effluent distributed by the tank.

According to an additional feature of the invention, the tank is provided with a takeoff system intended to take off effluent at regular intervals. This takeoff system can consist for example of an additional reservoir secured to the bucket and which can take the form of a vessel formed recessed on the bottom wall.

According to an additional feature of the invention, the vessel is integrated in or associated with the construction of a septic tank or a tank making it possible, in the same installation, to treat the effluent and then distribute it.

According to an additional feature of the invention, the tank or bucket is provided with a level instrument intended to verify the horizontal positioning of said tank or said bucket in order to correct it where necessary.

When the tank or bucket is correctly positioned, its functioning becomes optimum.

According to an additional feature of the invention, the level instrument is of the spirit level type, housed in a cell produced on the rim of the casing.

According to an additional feature of the invention, the tank is provided with a means of discharging the effluent into its bucket in order to obtain reproducible functioning thereof.

Advantageously, the discharge means consists of a sleeve connected to the effluent supply pipe, the sleeve, which is otherwise closed, having a plurality of holes passing through its bottom part, that is to say in its part intended to be turned towards the bucket, in order to direct the flow of effluent in the direction of the bucket.

According to an additional feature of the invention, the effluent supply pipe and/or the sleeve has a ventilation opening passing through the upper part in order to balance the pressure in a closed installation.

According to an additional feature of the invention, the vessel is closed by a second casing intended to be buried and being housed therein so as to be able to modify its relative position with respect to this second casing.

Advantageously, shoes are provided at the periphery of the bottom wall of the tank casing in order to cooperate with runners provided in the second casing, forming respectively portions of an arc of a circle around the axis of the effluent supply pipe.

According to an additional feature of the invention, a jack is interposed between the tank and the second casing in order to adjust the horizontality of said tank vis-à-vis the second casing.

According to an additional feature of the invention, the bucket is fixed so as to be articulated between its filling and discharge positions, in a cradle provided with a pivot mounted so as to be articulated on the bottom in order to be able to adjust the horizontality of said bucket.

By turning this cradle through ±180°, the side on which the effluent is discharged into the tank is also changed.

According to an additional feature of the invention, the emptying openings are provided on at least two sides of the tank casing and the bucket has at least two distinct locations.

According to an additional feature of the invention, a manifold connects at least two emptying openings.

Figure 2:
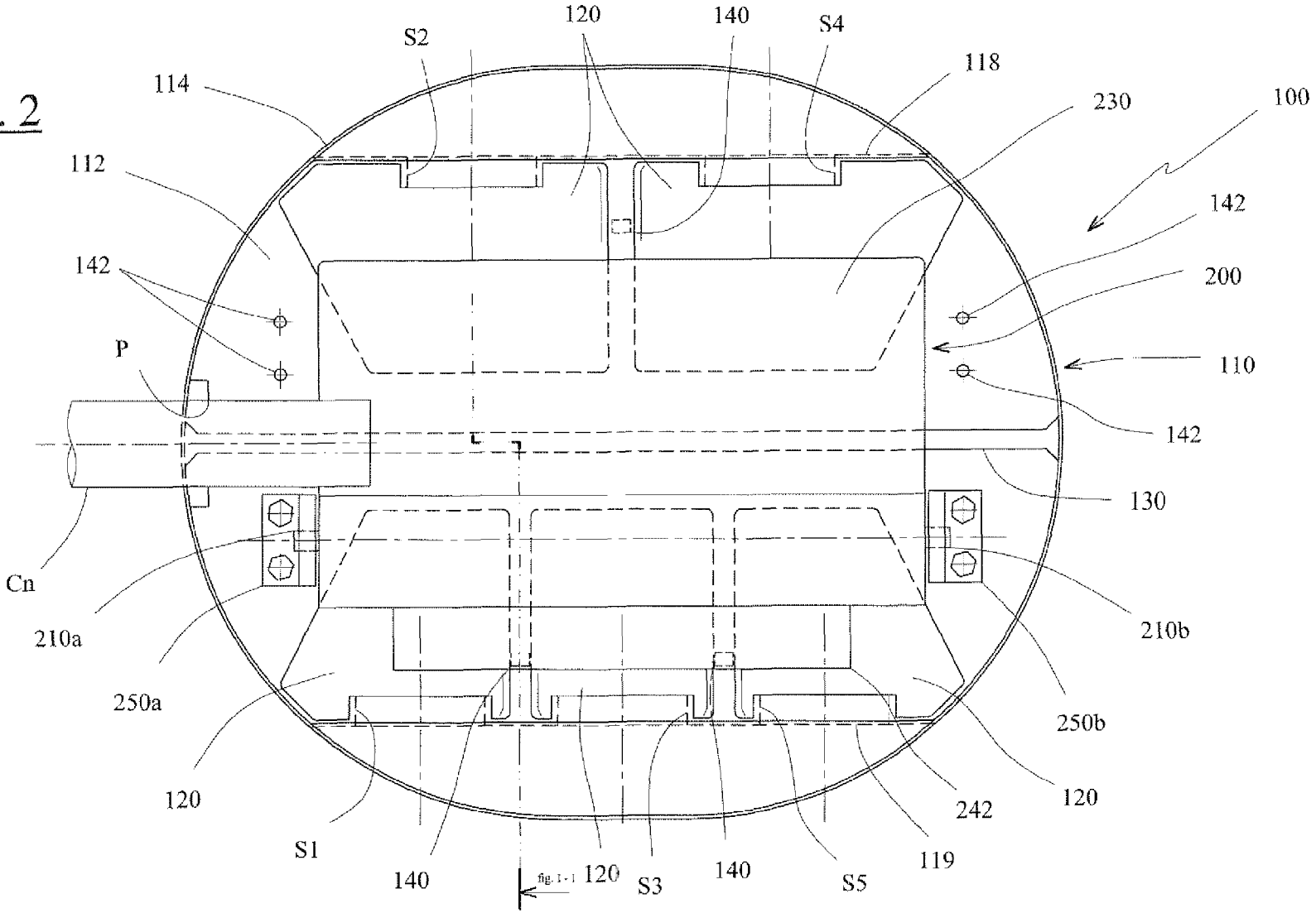
Figure 3:
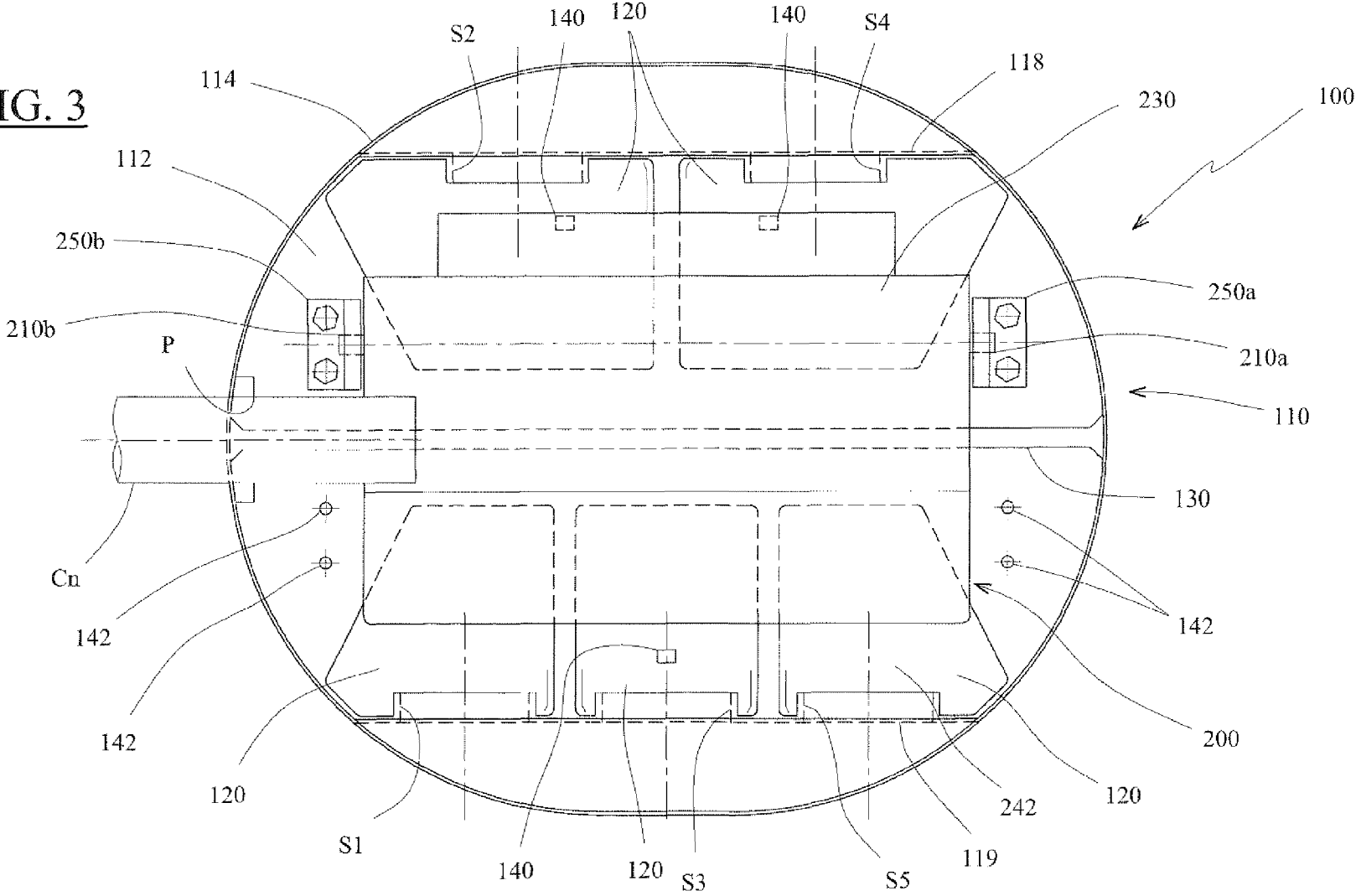
Figure 4A:
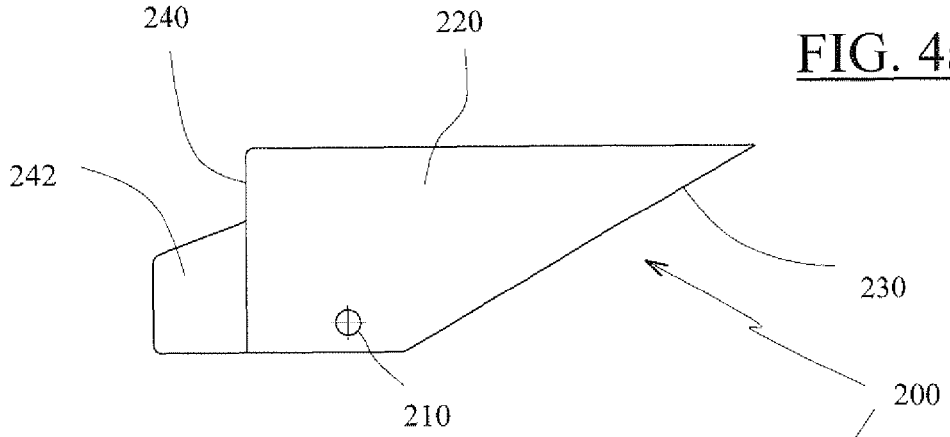
Figure 4B:
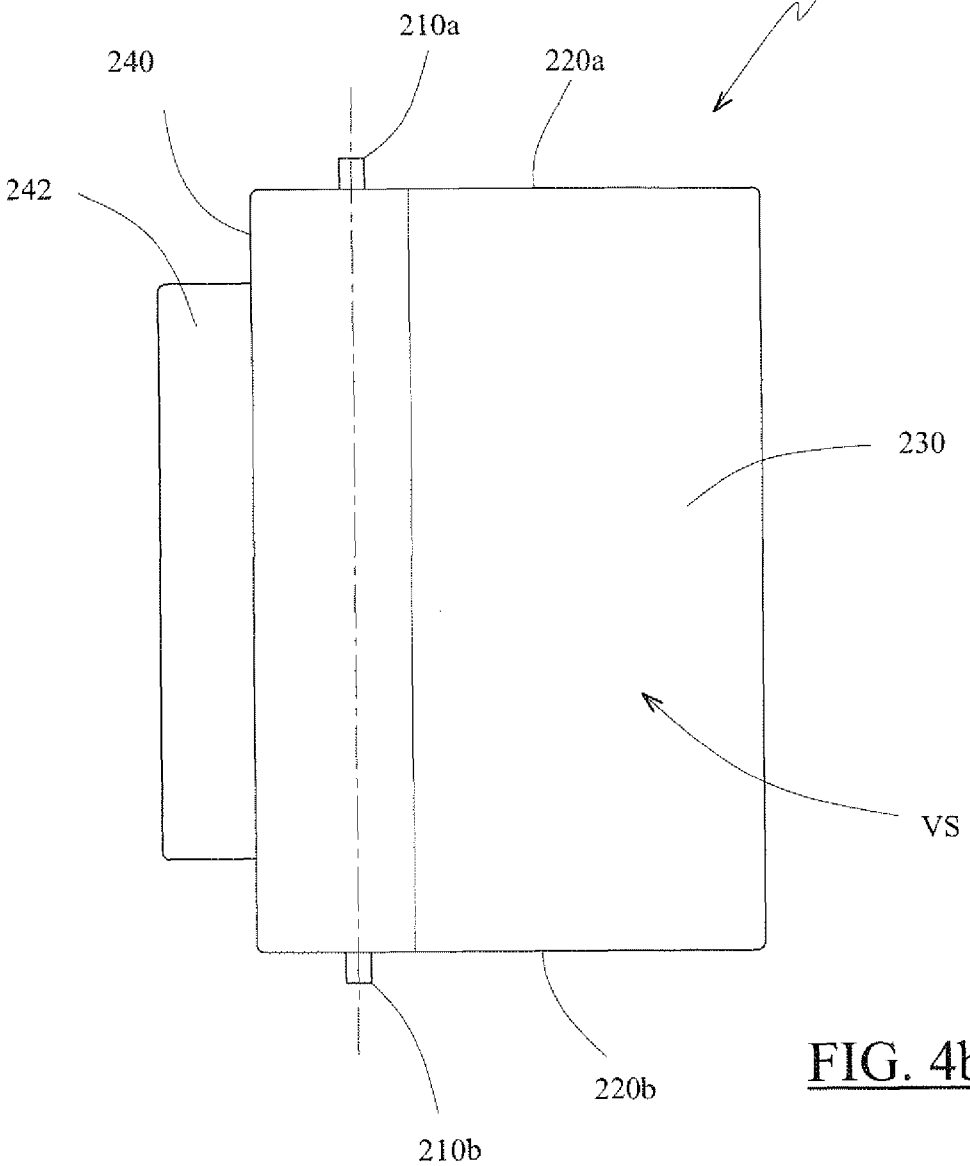
Figure 5:
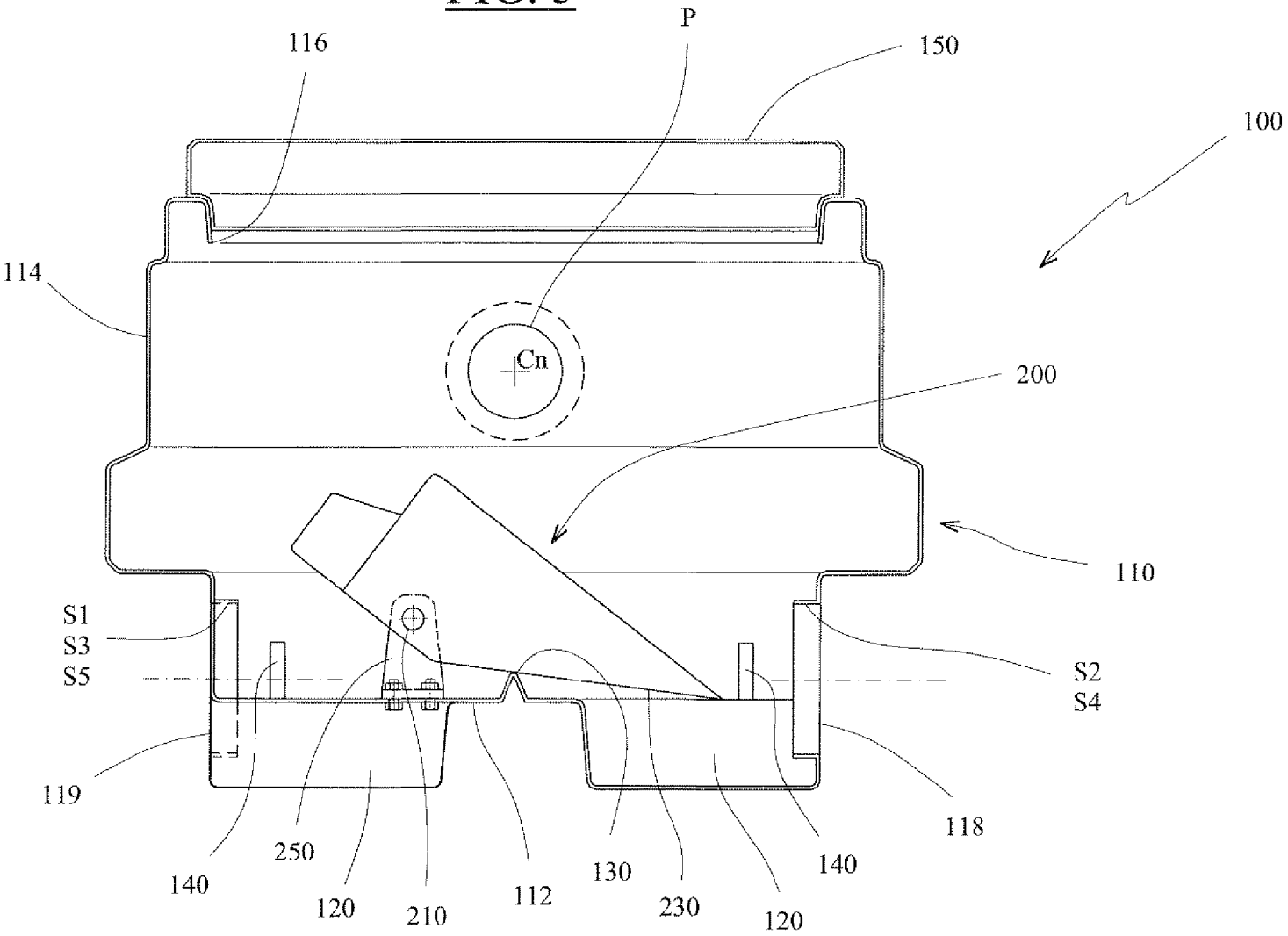
Figure 6A:
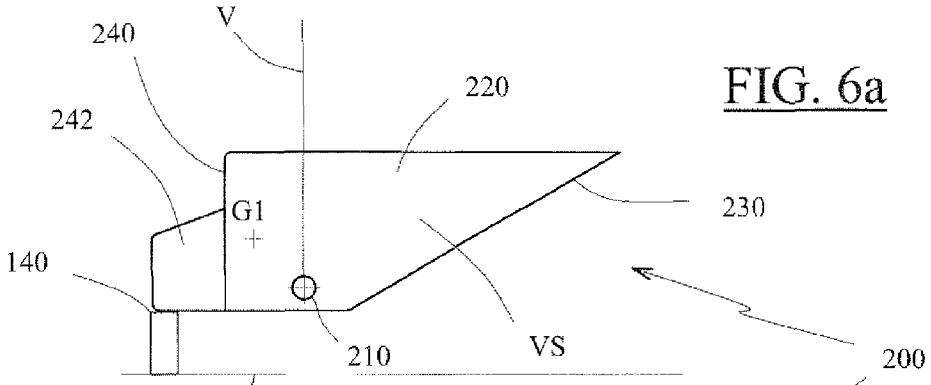
Figure 6B:
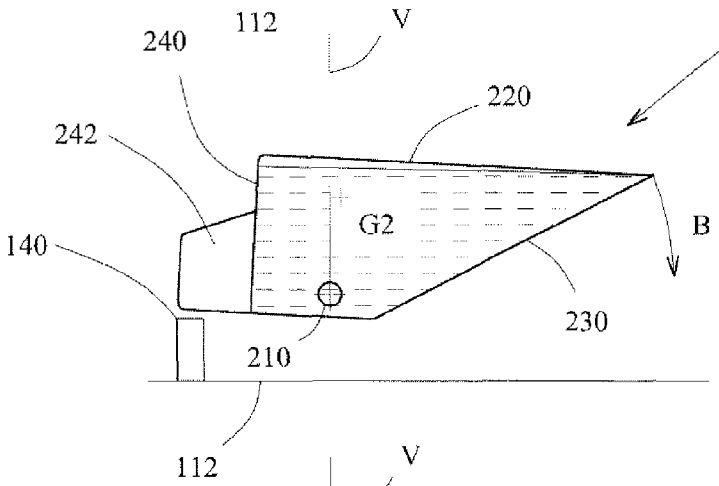
Figure 6C:
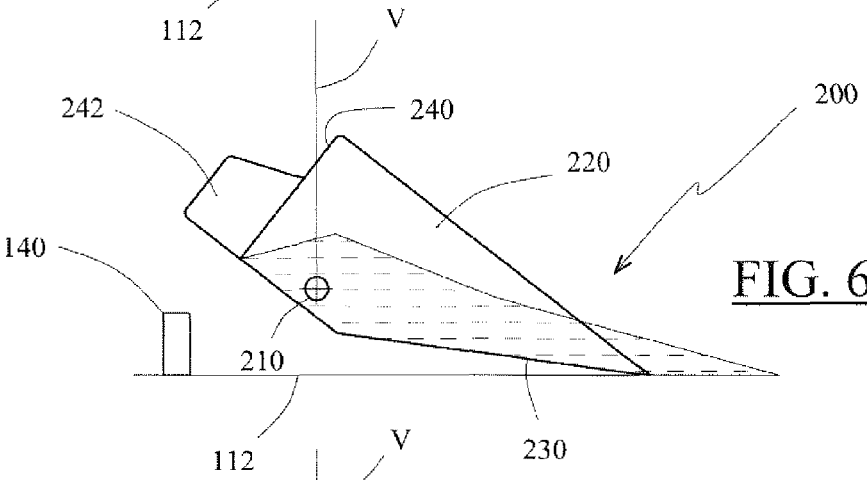
Figure 6D:
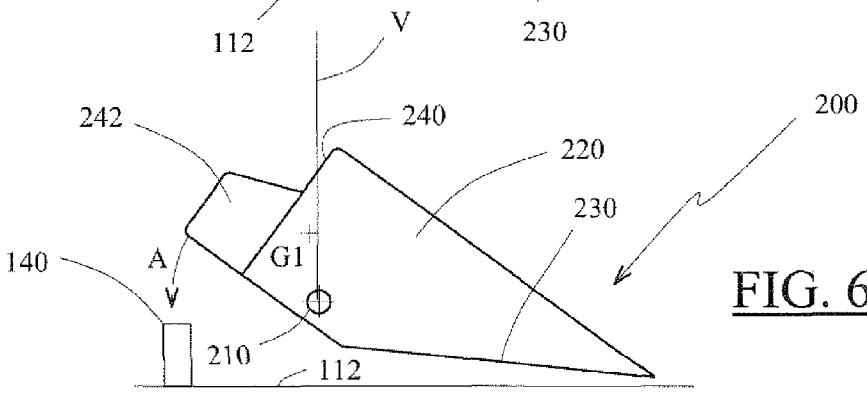
Figure 7:
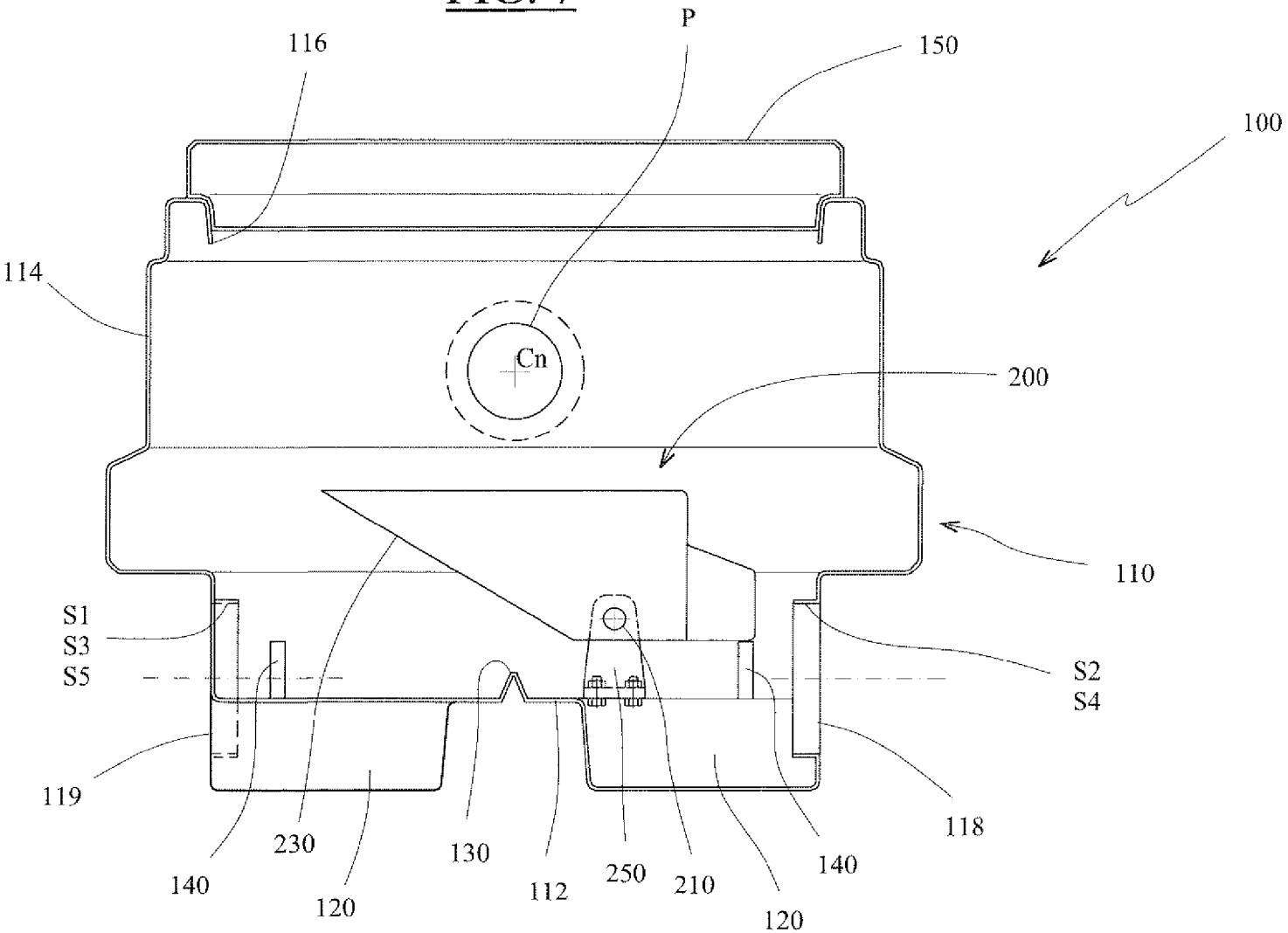
Figure 8A:
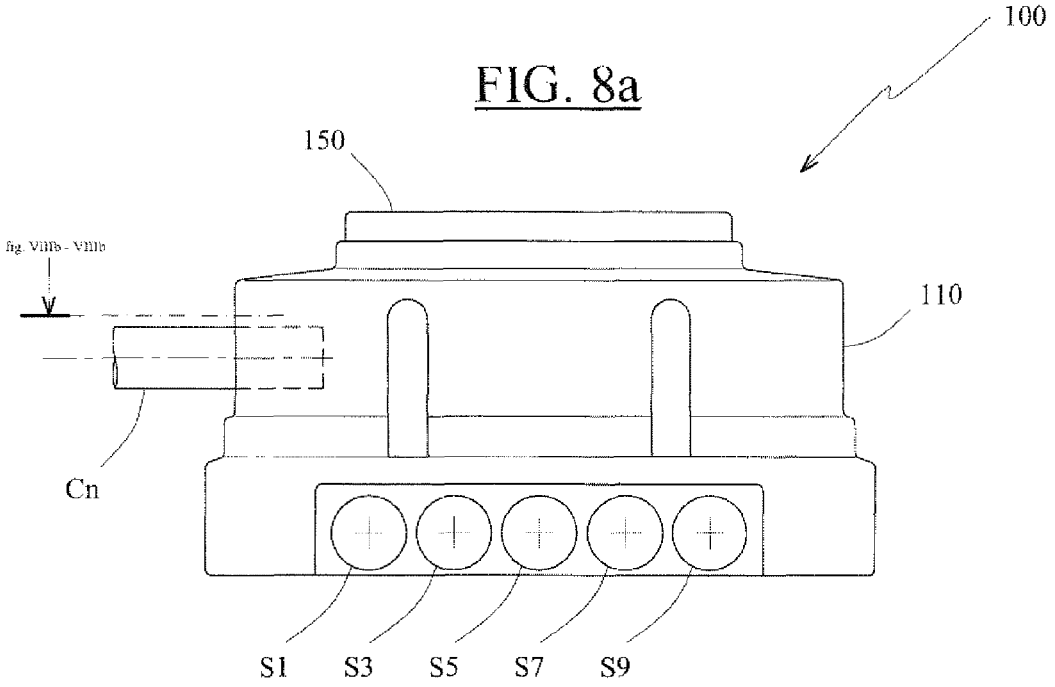
Figure 8B:
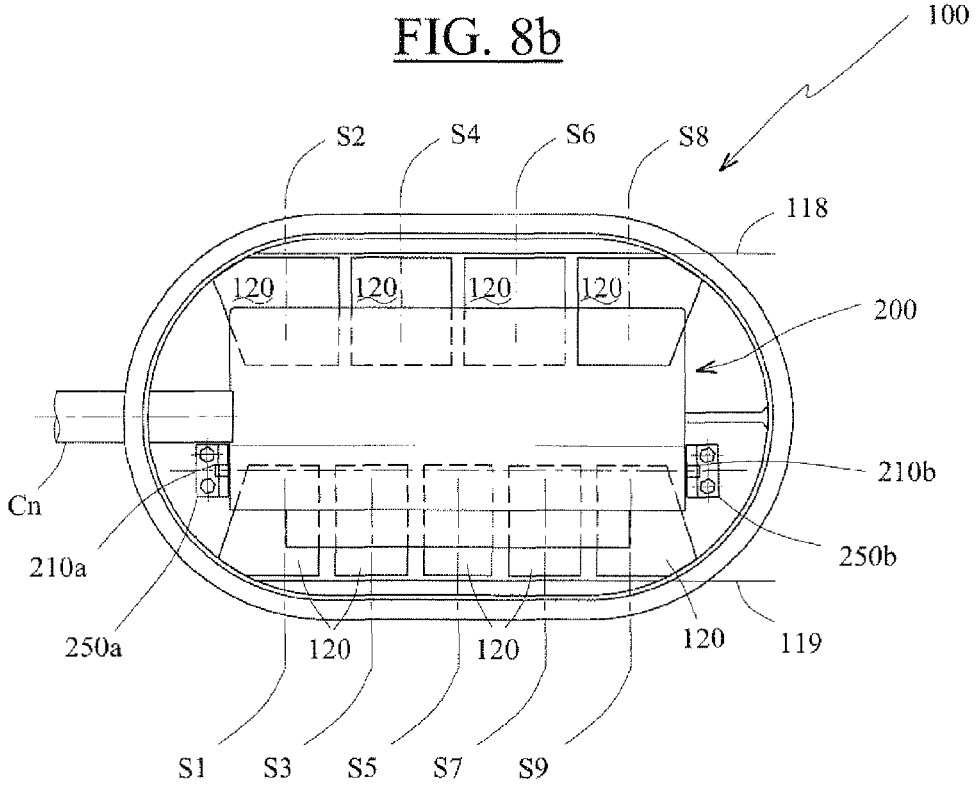
Figures 10C, 10D, 11:
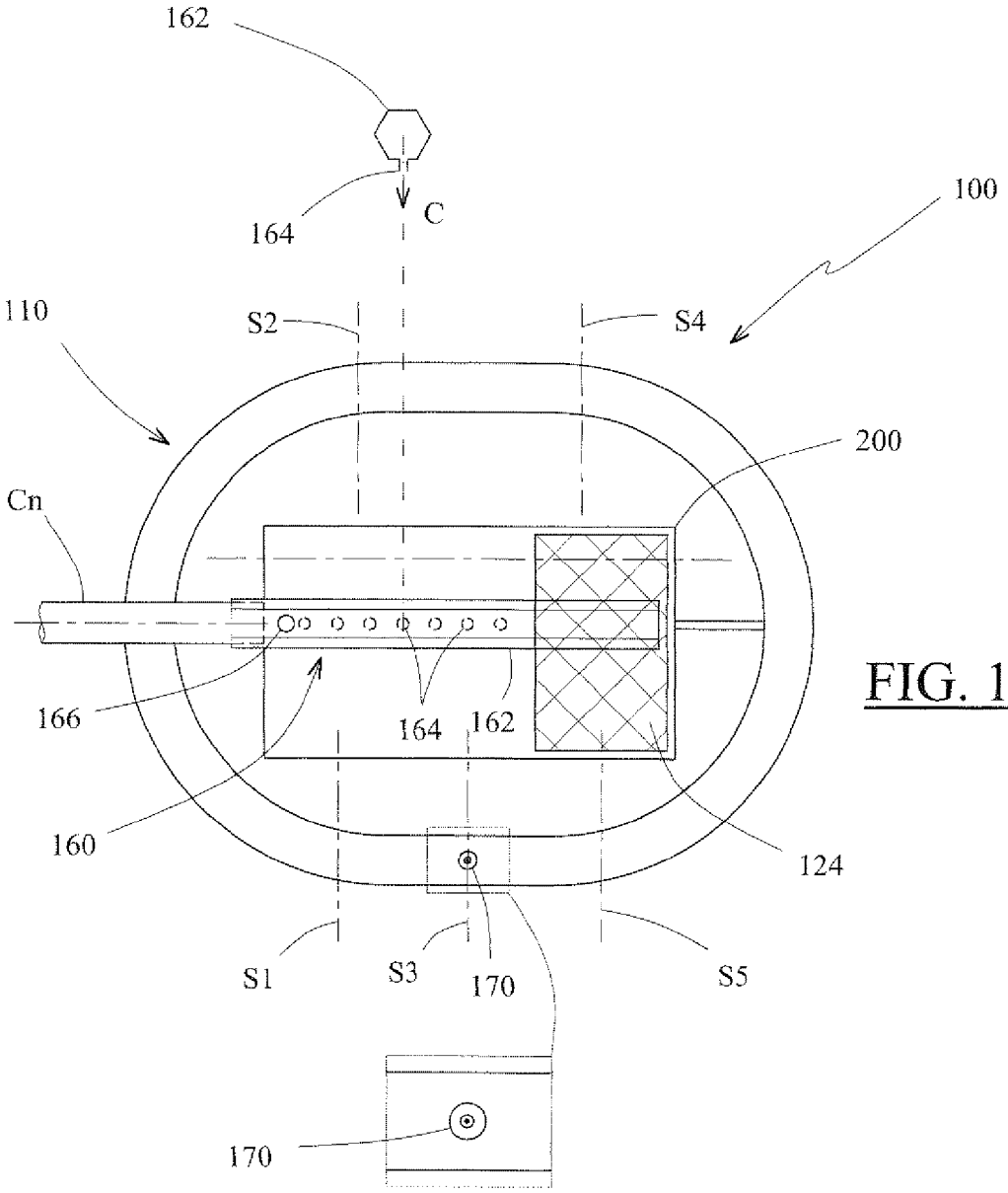
Figure 12:
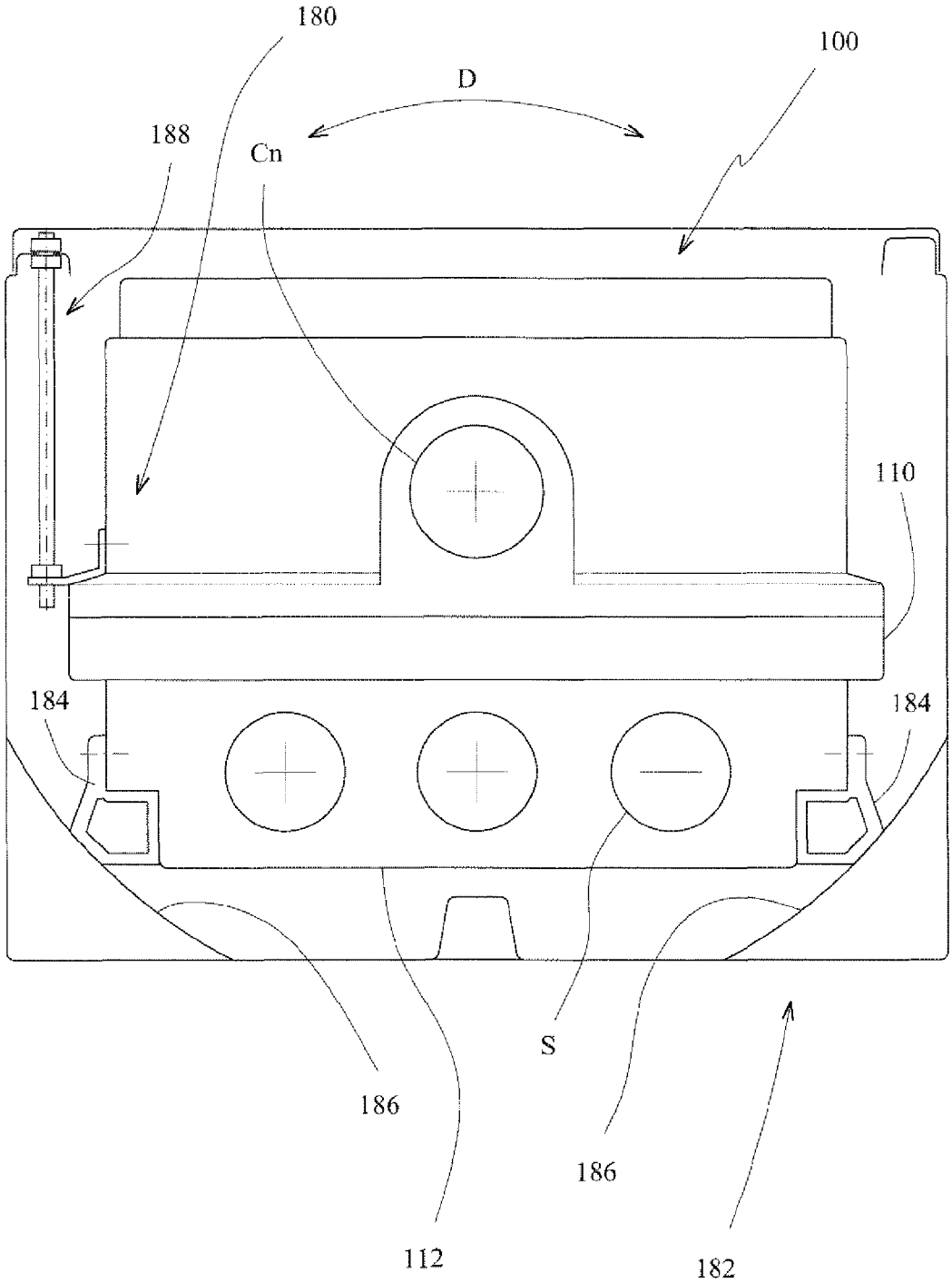
Figure 13A:
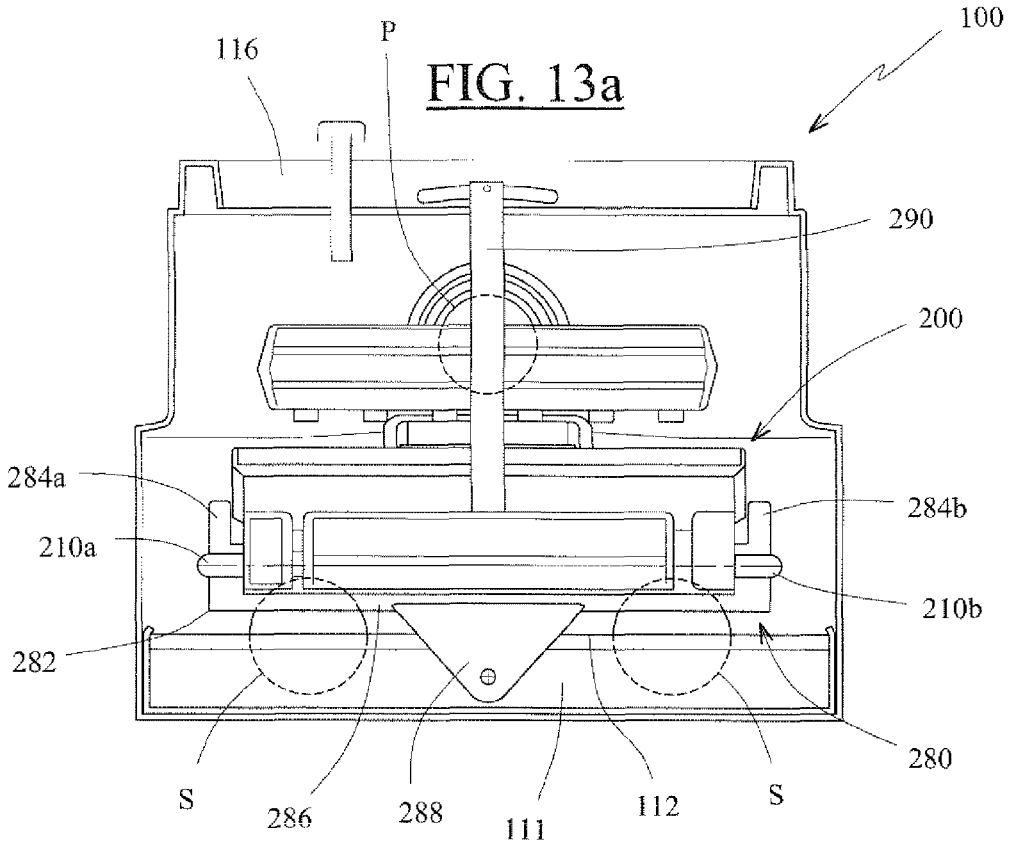
Figure 13B:
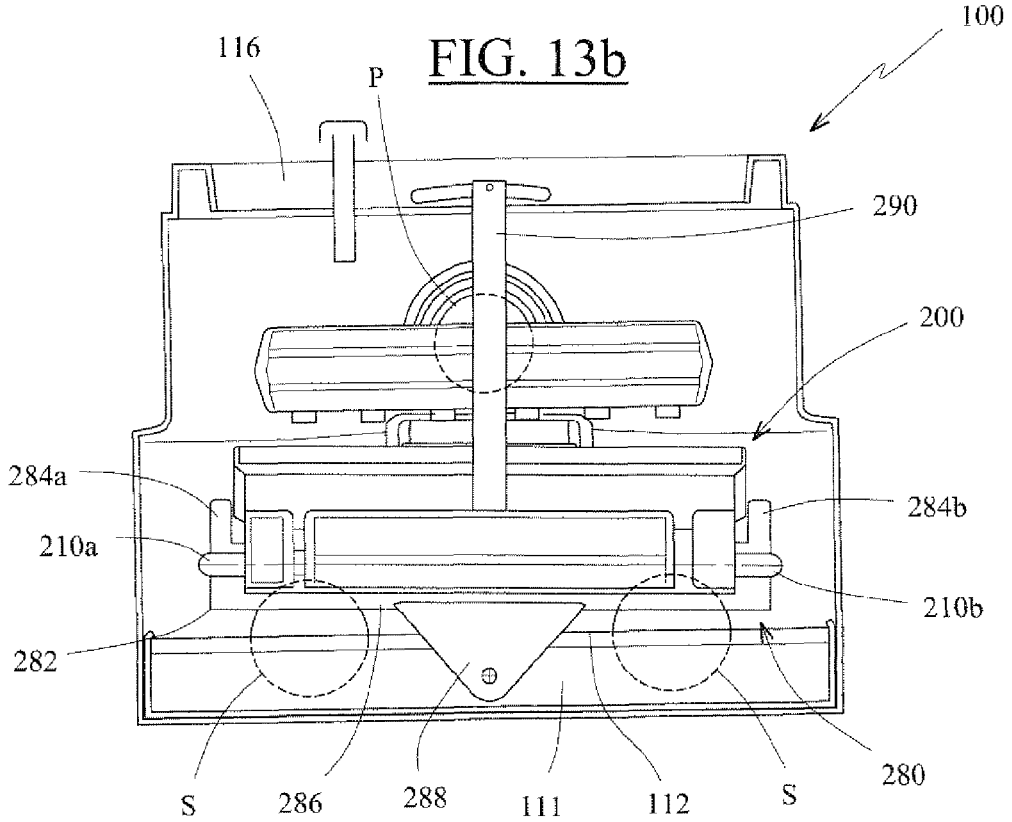
Figure 14A:
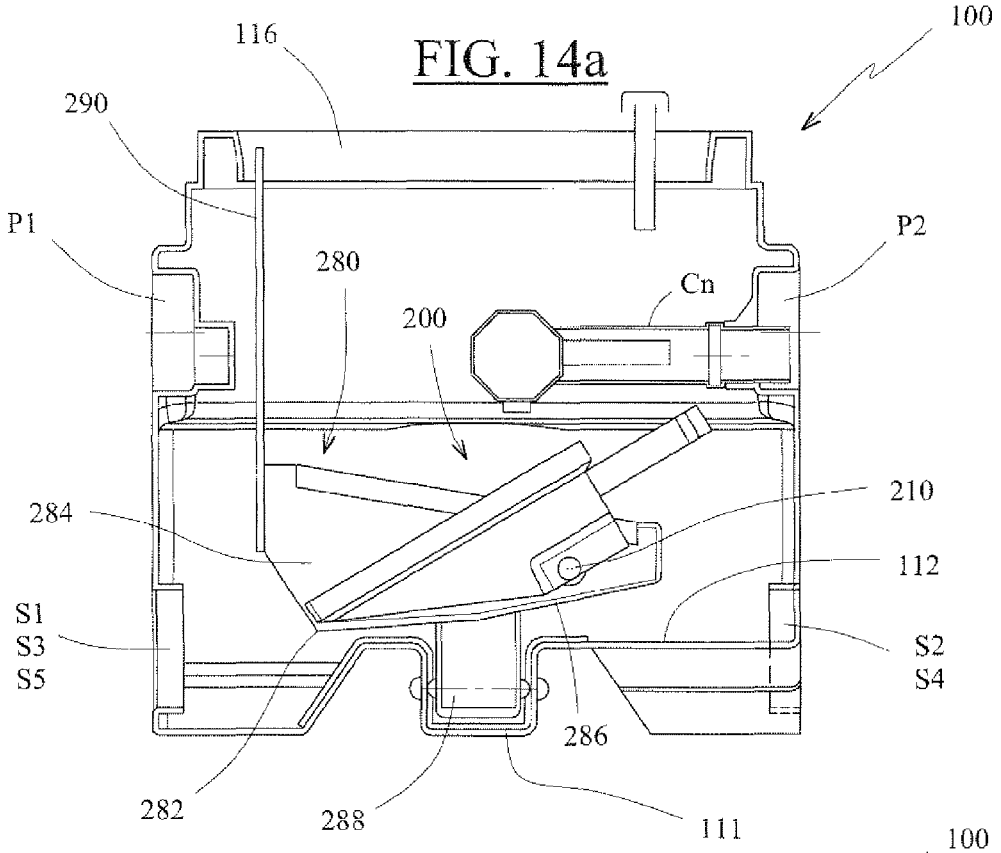
Figure 14B:
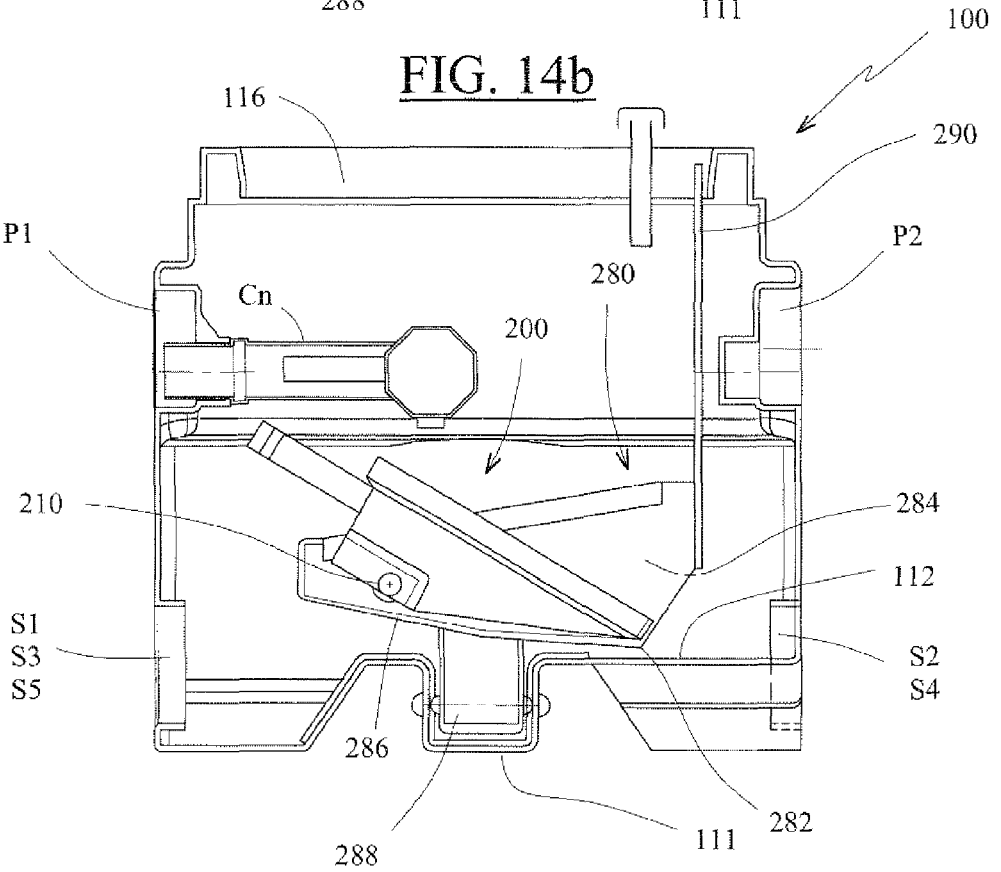
Figure 15A:
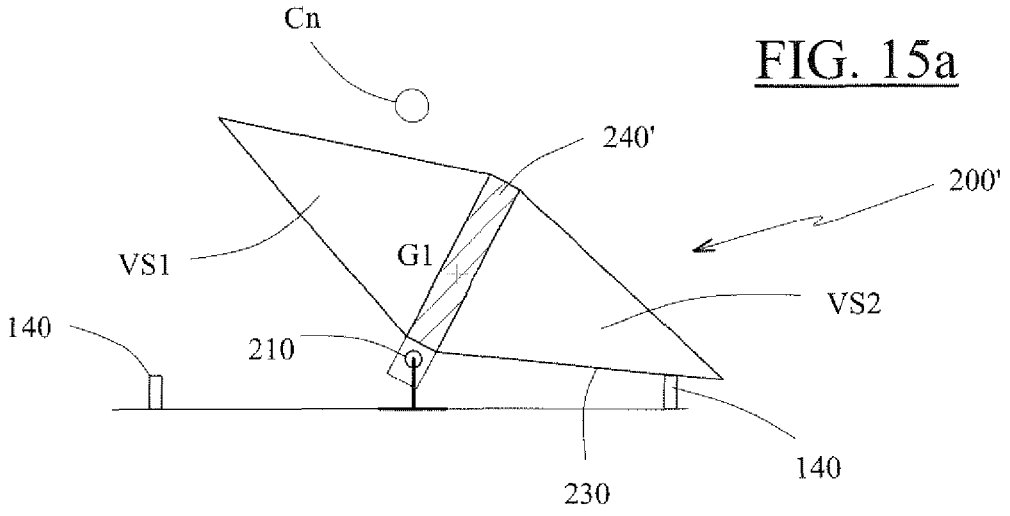
Figure 15B:
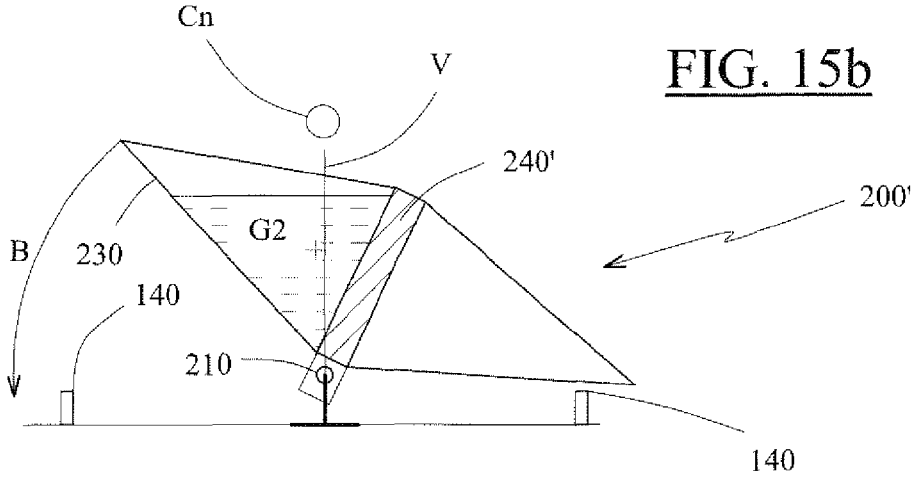
Figure 15C:
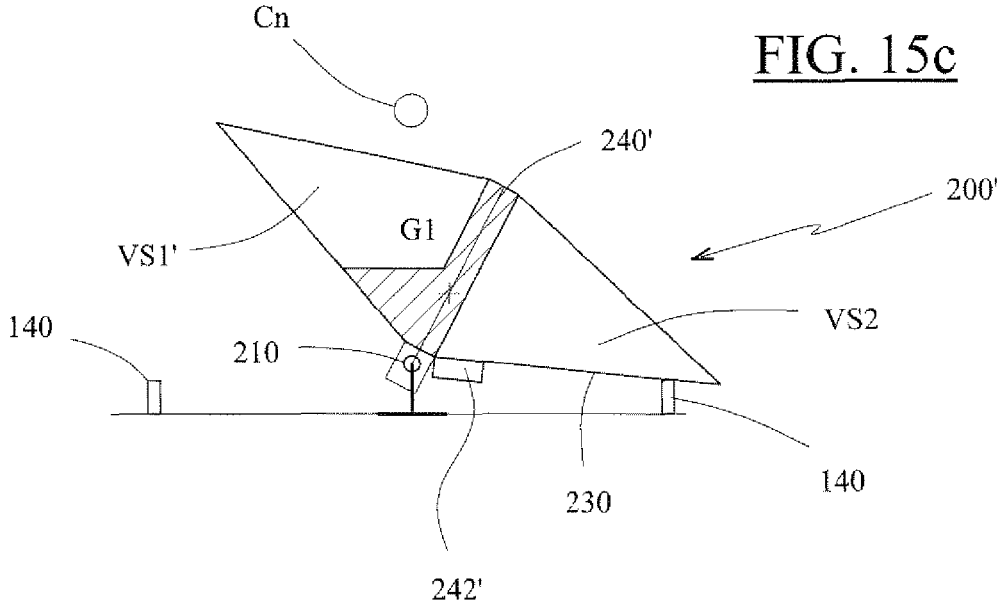
Figure 15D:
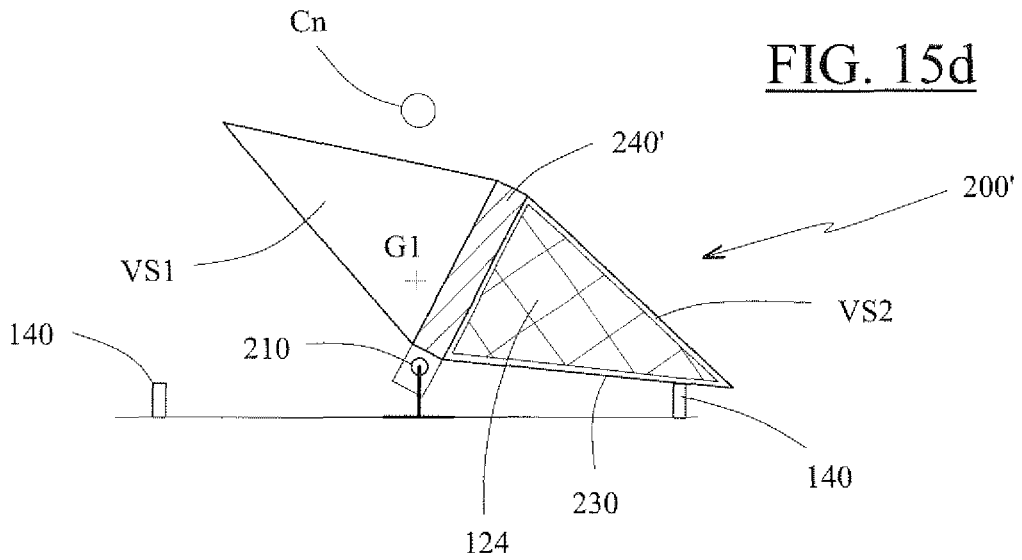
Figure 16:
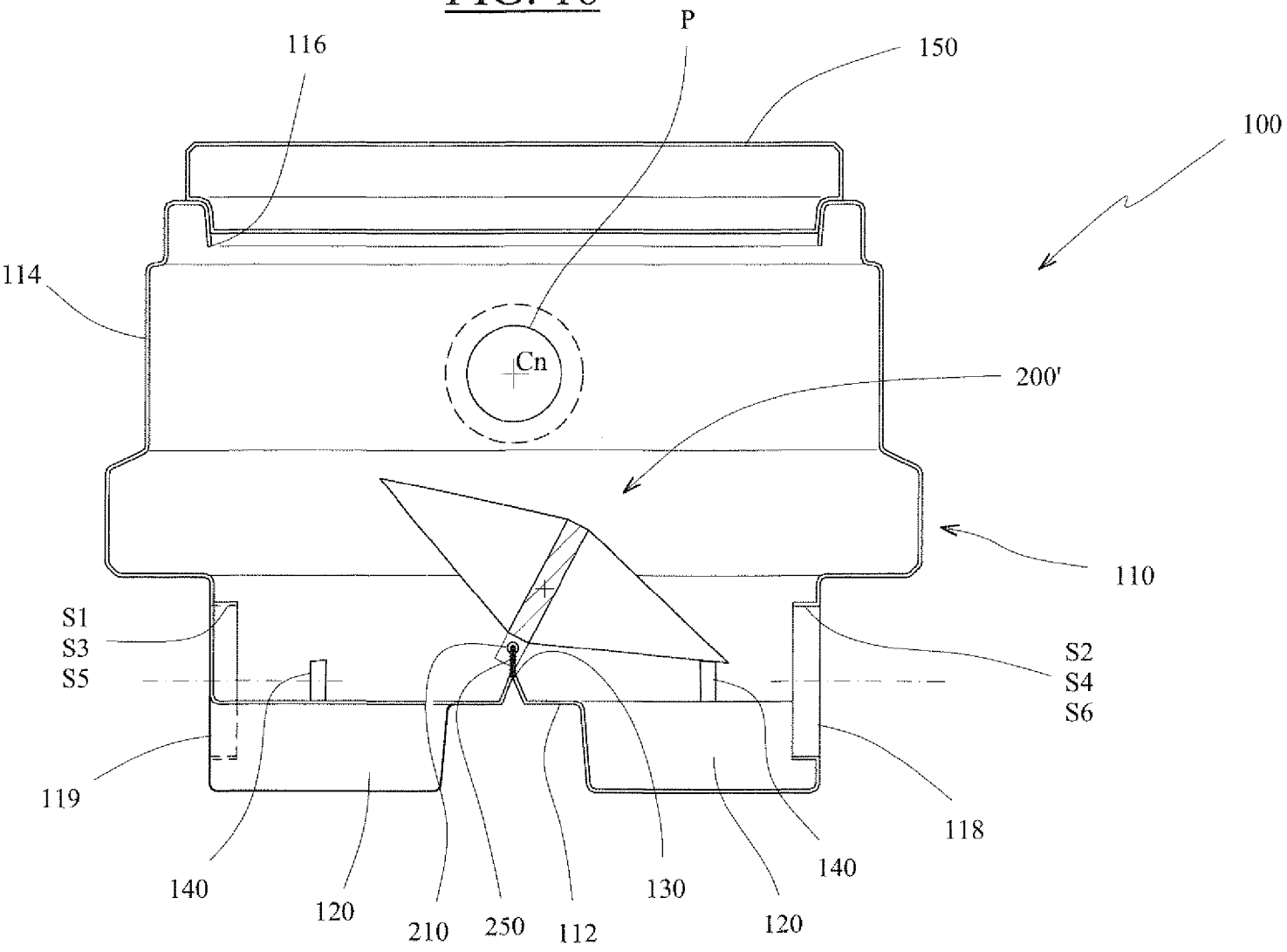
Figure 17:
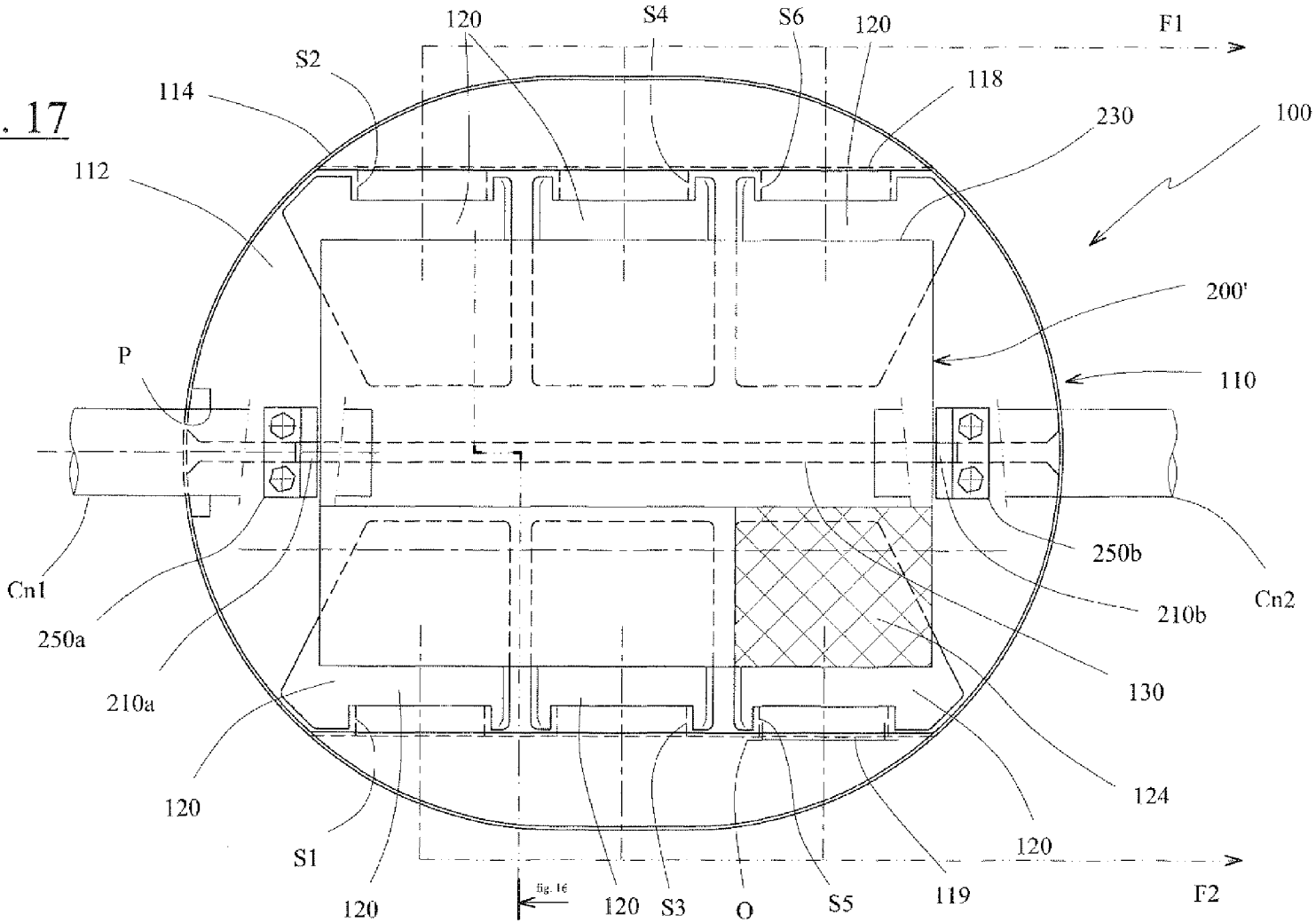
Figure 18:
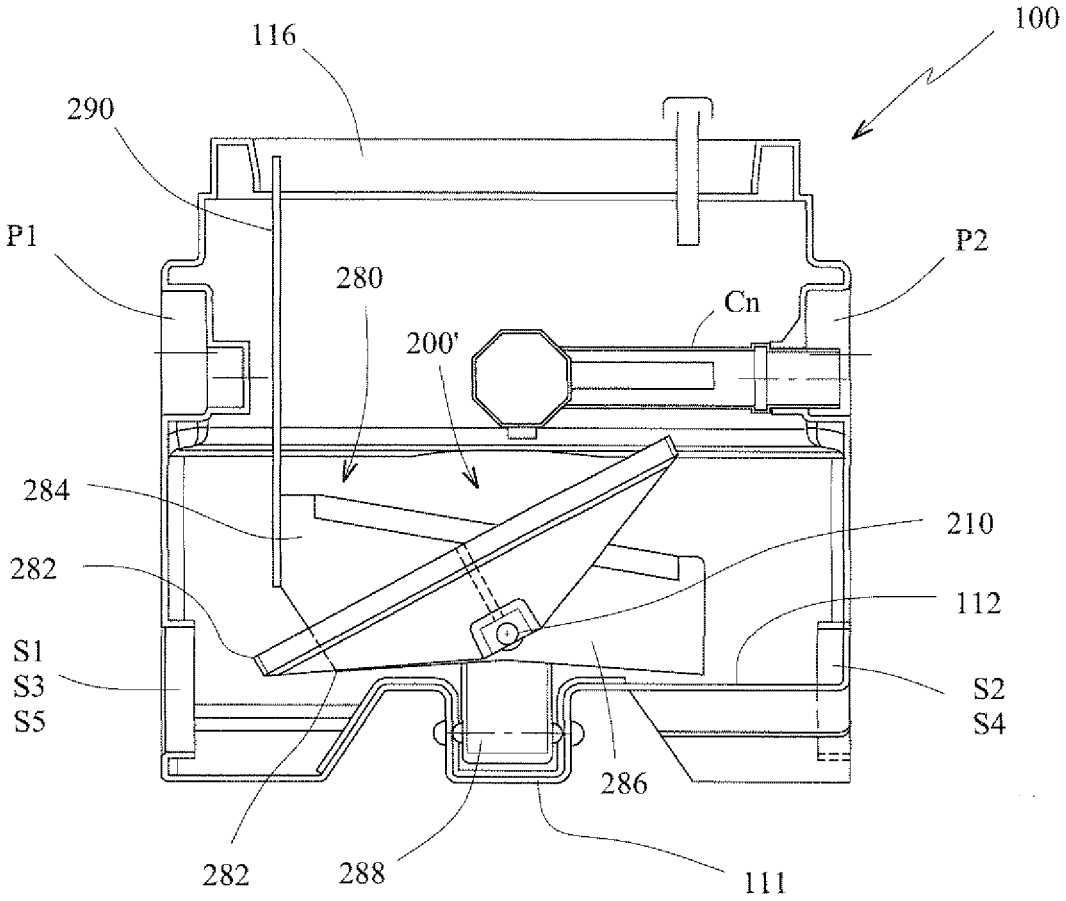
Figure 19:
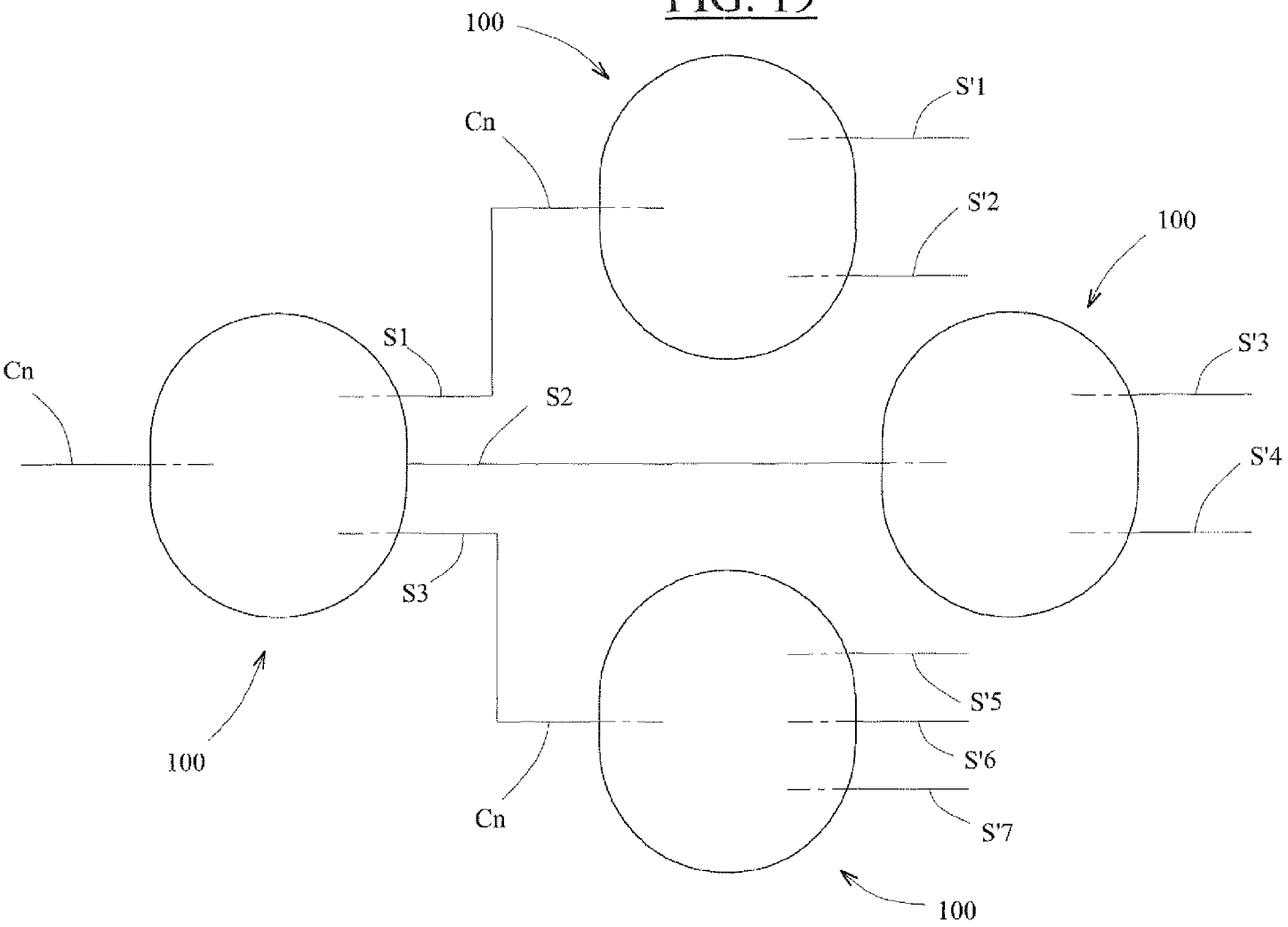
Figure 20:
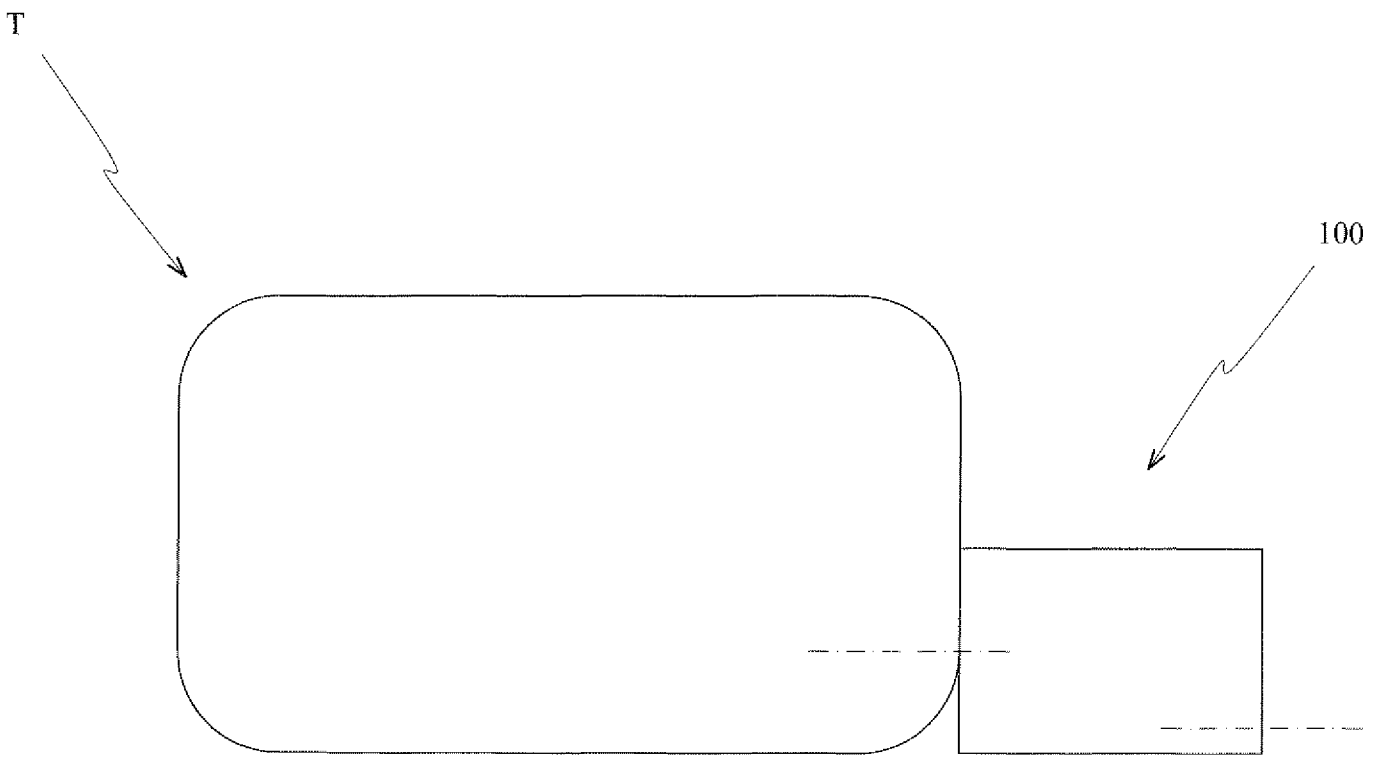
Figure 21:
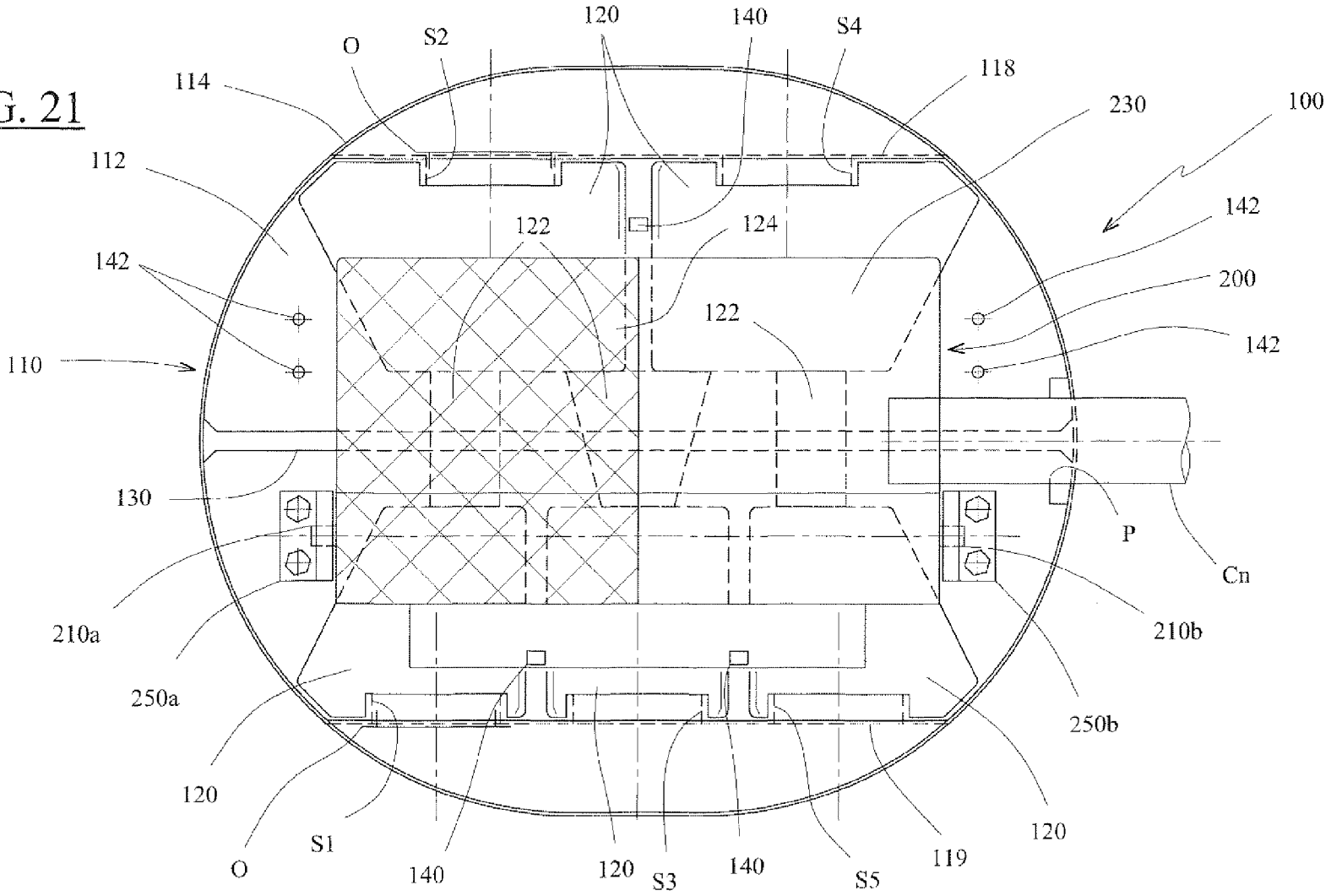

The features of the invention mentioned above, as well as others, will emerge more clearly from a reading of the following description of an example embodiment, said description being given in relation to the accompanying drawings, among which:

FIG. 1 shows a view in section of a tank with bucket, where the tank of the unidirectional type is placed in a filling position according to the invention, FIG. 2 shows a plan view in section of a tank with bucket according to the invention, FIG. 3 shows a plan view in section of a tank with bucket where the bucket is placed in a reversed position with respect to FIG. 2 according to the invention, FIG. 4*a* shows a side view of a bucket of the unidirectional type for a tank with bucket according to the invention, FIG. 4*b* shows a plan view of a bucket of the unidirectional type for a tank with bucket according to the invention, FIG. 5 shows a side view in section of a tank with bucket where the bucket of the unidirectional type is placed in a discharge position according to the invention, FIG. 6*a* shows a side view of a bucket of the unidirectional type oriented in a filling position according to the invention, FIG. 6*b* shows a side view of a bucket of the unidirectional type oriented in a position of start of discharge according to the invention, FIG. 6*c* shows a side view of a bucket of the unidirectional type oriented in a discharge position according to the invention, FIG. 6*d* shows a side view of a bucket of the unidirectional type oriented in a position of return to its filling position according to the invention, FIG. 7 shows a view in section of a tank with bucket where the bucket of the unidirectional type is fixed at another location according to the invention, FIG. 8*a* shows a front view of a variant embodiment of a tank with bucket according to the invention, FIG. 8*b* shows a plan view of a variant embodiment of a tank with bucket according to the invention, FIG. 9 shows a view of a variant embodiment of a wall forming a barrage on the bottom of the tank according to the invention, FIG. 10*a* shows a plan view of a casing of a tank with bucket provided with a means of discharging the effluent in its bucket according to the invention, FIG. 10*b* shows a view in section of the discharge means presented in FIG. 10*a* according to the invention, FIG. 10*c* shows a plan view of a casing of a tank with bucket provided with a variant of a means of discharging the effluent in its bucket according to the invention, FIG. 10*d* shows a view in section of the discharge means presented in FIG. 10*c* according to the invention, FIG. 11 shows a plan view of a detail of a easing of a tank with bucket provided with a means of checking its horizontality according to the invention, FIG. 12 shows a view of a tank with bucket enclosed in a casing enabling the horizontality of said vessel to be adjusted according to the invention, FIG. 13*a* shows a view in longitudinal section of a tank provided with a means for adjusting the horizontality of its bucket, the tank being disposed in a horizontal position according to the invention, FIG. 13*b* shows a view in longitudinal section of a tank provided with a means for adjusting the horizontality of its bucket, the tank being disposed in a slightly inclined position according to the invention, FIG. 14*a* shows a view in transverse section of the tank presented in FIG. 12*a* according to the invention, FIG. 14*b* shows a view in transverse section of a tank presented in FIG. 13*a* where the location of the effluent supply pipe and the location of the bucket have been changed according to the invention, FIG. 15*a* shows a view in section of a bidirectional-discharge bucket of the symmetrical type oriented in one of its two discharge positions according to the invention, FIG. 15*b* shows a view in section of a bidirectional-discharge bucket of the symmetrical type in the course of tilting towards its other discharge position according to the invention, FIG. 15*c* shows a view in section of a bidirectional-discharge bucket of the asymmetric type according to the invention, FIG. 15*d* shows a view in section of a bidirectional-discharge bucket of the symmetrical type oriented in one of its two discharge positions according to the invention, FIG. 16 shows a view in section of a tank incorporating a bidirectional-type bucket according to the invention, FIG. 17 shows a plan view in section of a tank incorporating a bidirectional-type bucket according to the invention, FIG. 18 shows a view in transverse section of a tank incorporating a bidirectional-type bucket according to the invention, FIG. 19 shows a schematic view of a connection of several tanks with bucket according to the invention, FIG. 20 shows a schematic view of a tank with bucket associated with a septic tank according to the invention, FIG. 21 shows a plan view in section of another variant embodiment of a tank with bucket according to the invention, and FIG. 22 show diagrams of different configurations of tanks with bucket, in plan views, according to the invention.

The tank with bucket 100 presented in FIGS. 1 and 2 is intended mainly to be buried in the ground to allow the supply of infiltration systems or the irrigation of planted land, for example a plant bed. It is thus designed to be connected to a pipe for the continuous supply of an effluent for the purpose of episodically and suddenly releasing a volume of effluent through a plurality of emptying openings S connected respectively to effluent treatment installation pipes, or drains, not shown, distributed over the surface to be irrigated.

The tank with bucket 100 is composed of a casing 110 closed by a cover 150 and inside which an effluent discharge bucket 200 is installed.

The casing 110, the cover 150 and the bucket 200 are advantageously manufactured by a rotary moulding method.

The casing 110 is formed by a bottom wall 112 bordered by a belt wall 114 delimited opposite to the bottom by an opening 116 to enable the bucket 200 to be mounted. This opening 116 is normally closed by the cover 150, which also forms an inspection flap for access to the inside of the casing 110. Through this closed construction, the tank can be buried in order to keep it out of sight. This cover is held in place by means of bolts, not shown.

In FIG. 2, the casing 110 has an oblong section enabling a relatively large-volume bucket to be housed.

In FIGS. 1 and 2, a filling opening P passes through the belt wall 114 in order to have an effluent supply pipe Cn pass through it, connected for example to a waste water system. The filling opening P is positioned so that the supply pipe Cn can emerge above the bucket 200 in order to fill it.

Effluent emptying openings S also pass through the belt wall 114 while being situated below the supply pipe Cn. These emptying openings are divided into two rows disposed respectively on two opposite walls 118 and 119, constituting said belt wall 114. The number of these emptying openings is preferably different from one row to another. In this way two emptying openings S2 and S4 can be seen on the wall 118 and three emptying openings S1, S3 and S5 on the wall 119. In these FIGS. 1 and 2, it will be noted that the axis of the filling opening P is perpendicular to the axis of the emptying openings S.

Each of these openings S emerges respectively in a vessel 120 for receiving effluent formed recessed in the bottom wall 112 of the casing 110. In a variant embodiment, not shown, these reception vessels consist of attached elements that can be replaced.

The tanks situated on the same row preferably have a common capacity.

The bucket 200 is designed to cyclically discharge the quantity of effluent with which it was filled, into the vessels in the same row. Each vessel 120 thus constitutes a temporary reservoir for supplying effluent to the corresponding emptying opening at the end of the discharge of the bucket 200.

The bucket 200 is mounted articulated between a filling position, visible in FIG. 1, and a discharge position visible in FIG. 5.

In FIG. 4, it consists of a container with a prismatic cross section (in plan view) forming a storage volume VS for the effluent, open on its upper face intended to be turned upwards. It thus comprises two side walls 220 joined by a front wall 230 extended by a bottom wall and a back wall 240.

Two shafts 210*a* and 210*b* with a common axis project outside respectively its two side walls 220*a* and 220*b* to enable the bucket to be fixed in the tank casing.

The front wall 230 with a flat structure forms an acute angle with the rim of the side walls 220 in order firstly to constitute an overflow to the bucket when it tilts towards its discharge position and secondly so that its centre of gravity can, during filling thereof, pass through a vertical plane passing through the axis of the two shafts 210. This aspect is developed with reference to FIGS. 6*a* to 6*d*. It should be noted that the front wall 230 is also flat as permitted by the method of manufacturing the bucket. The latter can, for this purpose, be provided with at least one intermediate reinforcement wall for limiting the flexion of this front wall.

In FIG. 6*d*, the centre of gravity G1 of the empty bucket 200 is situated, with respect to a vertical plane V passing through the axis of the shafts 210, on the other side of the discharge wall 230 so that the bucket can be returned by gravity, at the end of the emptying thereof, to its filling position as shown by the arrow A.

In order to position in this way the centre of gravity G1, a counterweight 242 can be attached against the back wall 240. This counterweight can consist of a ballast. It will be noted that the bucket 200 shown in these FIGS. 4 and 6 is of the unidirectional discharge type, that is to say it always discharges its content on the same side.

A stop 140 formed in the bottom wall 112 of the tank casing limits the tilting of the bucket into its filling position, where the rims of the side walls 220 are almost horizontal, as is clear in FIG. 6*a*.

When it fills with effluent, as shown in FIG. 6*b*, the centre of gravity G2 passes through the vertical plane V so that it rapidly tilts in the direction of its discharge position, as shown by the arrow B.

In FIG. 6*c*, the bucket has reached its discharge position, where the free edge of its discharge wall 230 comes into contact with the bottom wall 112. When the bucket 200 empties, its centre of gravity once again passes through the vertical plane V in order to return to the position G1 indicated in FIG. 6*c*, so that once again it tilts to its filling position, where a new cycle begins.

In FIGS. 1 and 2, the two shafts 210 of the bucket 200 are held respectively in two bearings 250 secured to the casing 110. Each bearing has an L-shaped cross section and comprises a vertical wall through which a housing passes in which the end of a shaft can swivel and a horizontal wall fixed by bolting to the bottom wall 112 of said casing in holes (not visible).

Thus the bucket 200 is filled with the effluent discharged through the supply pipe and then, when it is full, automatically tilts to its discharge position, where it abruptly discharges the quantity that it contains into the vessels 120 in the same row, which supply the corresponding emptying openings S connected to drains in order to infiltrate the ground or connect it to an authorised outfall.

A wall 130 forming a barrage separates the bottom wall 112 between the two rows of emptying openings S in order to contain the discharged effluent so that it flows solely into the vessels in said row. The quantity of effluent that is discharged through the emptying openings and is equal to the quantity of effluent stored in the bucket 200 at the time of discharge thereof, thus remains constant.

In these FIGS. 1 and 2, the wall 130 is formed in a longitudinal mid-plane of the casing 110 and separates the bottom wall 112 into two almost identical surfaces.

In FIG. 9, the wall 130 consists of an element attached in a groove provided in the bottom wall 112.

It will be noted, in FIG. 2, that the discharge wall 230 of the bucket 200 is turned towards the two emptying openings S2 and S4 produced through the wall 118. It is possible to prepare the tank with bucket 100 of the invention so that it supplies the other three emptying openings S1, S3 and S5 in replacement for the two emptying openings S1 and S2 in order to procure increased versatility in use for said tank. The unused emptying openings, that is to say those situated on the side opposite to the emptying, are closed by obturators, not shown. It is also possible to close off at least one opening situated on the emptying side and, matching each closed-off opening, a mask, not shown in this FIG. 2, can be placed on the bucket in order to keep a distribution distributed in a balanced manner between the other outlets. Such a mask 124 is shown in FIG. 17 opposite the emptying opening S5. This mask is preferably removable and the volume thereof can be adapted so that the bucket can discharge a predefined quantity of effluent. An obturator O closes off this corresponding non-supplied emptying opening S5.

In FIG. 2, other holes 142 are also provided in the bottom wall 112 of the casing 110 in order to fix at another location the bearings 250 guiding the shafts 210 of the bucket 200. These holes 142 are provided symmetrically to the wall 130 to enable the bucket 200 to be inverted so that it can discharge its content into the three vessels 120 connected to the three emptying openings S1, S3 and S5.

The bearings can also be of the non-demountable type, but in sufficient numbers to be able to change the location of the bucket.

In FIG. 3, the bucket 200 has been turned with respect to its position in FIG. 2 so that it can discharge its content in the opposite direction. For this purpose, the bearings 250 have been demounted and then placed on the other holes 142. The bucket is then turned over and its shafts 210 are housed in the bearings 250, which are then fixed in the bottom wall 112 of the casing 110.

Such a tank 100 is also presented in FIG. 7. Another stop 140 formed in the bottom wall 112 of the tank casing limits the tilting of the bucket in its filling position.

By virtue of this option of being able to reverse the location of the bucket in the tank, the direction of discharge of the effluent can be modified by simple reversal of the bucket, that is to say without being obliged to remove the tank from the ground.

In the variant embodiment of the tank with bucket 100 presented in FIGS. 8*a* and 8*b*, it is provided with two rows of openings for emptying the effluent comprising respectively four and five emptying openings S. This tank, of larger capacity, makes it possible to supply a larger number of drains or pipes.

In order to offer a more complete range of tanks with bucket, other tanks with bucket have a number of emptying openings different from those presented here, for example one opening on one side and two on the other side, or a larger number of openings in order to suit applications in the field of communities. In order to construct such a tank, it may be advantageous to insert at least one intermediate portion between the two end portions. By using one or more intermediate portions, the capacity of the tank with bucket is increased.

The functioning of the tank with bucket 100 is as follows. A trench is dug at the location where the vessel is placed, and a material intended to constitute a seat is deposited therein, for example a concrete slab is poured and the tank is deposited by placing it level with it. The effluent supply pipe Cn and the drains are connected to the corresponding emptying openings S. The unused emptying openings are blocked by obturators. The cover 150 is positioned and the surroundings of the vessel are backfilled.

In operation, the bucket is filled and then emptied automatically in a cyclic manner in the corresponding drains or pipes.

The double position of placement of its bucket makes it possible to adapt the tank to devices in different numbers or to devices turned in opposite directions.

The tank with bucket of the invention makes it possible to adapt an effluent distribution mode to variable modes of supply of this effluent.

It functions with a slight difference in level between its effluent filling opening and the various outlets. This facilitates installation thereof where a minimum slope is required.

In FIG. 10*a*, the tank with bucket 100 is provided with a means 160 of discharging the effluent into its bucket 200 in order to obtain reproducible and controlled functioning of the latter. The discharge means 160 consists of a sleeve 162 connected to the effluent supply pipe Cn. This sleeve, which is otherwise closed, has passing through its lower part, that is to say in its part intended to be turned towards the bucket 200, a plurality of holes 164 for vertically directing the flow of effluent in the direction of the bucket 200, as shown by the arrow C. The discharge means 160 makes it possible to absorb the variations in flow rate coming from the pipe Cn. It thus regularises the flow of effluent into the bucket 200 so that it always empties in the same way, that is to say when a precise quantity of effluent fills it. Moreover, the regular flow of effluent through the holes 164 in no way disturbs the normal functioning of the bucket 200.

In FIG. 10, the sleeve 162 takes the form of T when the effluent supply pipe Cn is disposed parallel to the emptying openings S, the holes 164 being disposed in the horizontal branch of the T, which advantageously has a polygonal cross section, as is clear in FIG. 10*b*. In a variant embodiment adapted to be connected to an effluent supply pipe disposed perpendicular to the outlet openings S, the sleeve consists of a tubular piece.

In FIG. 10*c*, the sleeve 162 consists of a rectilinear profile disposed in line with the pipe Cn. This pipe is disposed perpendicular to the emptying openings S. It should be noted that some holes 164 can be closed off or absent so that the effluent cannot flow over a mask 124 present in the bucket.

In addition, the pipe Cn or the sleeve 162 can have at least one ventilation opening passing through it, at the top part, preferably above the bucket 200, in order to balance the pressure in a closed installation. In FIGS. 10*b* and 10*c*, a ventilation opening 166 is produced on the sleeve 160.

In FIG. 11, the rim of the casing 110 is inserted in a cell of suitable size, a level instrument 170 such as a spirit level intended to display the positioning of the tank 100 in order to facilitate placing thereof in a perfectly horizontal position so that the flow rate of effluent can be distributed identically between the various emptying openings. A required precision is thus obtained in the distribution of the flow rate between the various emptying openings S. Such a level can also be installed on the bucket in order to check the position thereof.

In FIG. 12, the tank 100 is provided with a means 180 of adjusting the horizontality thereof in order if necessary to correct it if the terrain in which the tank is buried has moved over time. The tank is for this purpose enclosed in a second casing 182 intended to be buried and being housed therein so as to be able to modify its relative position with respect to this second casing 182. Shoes 184 are placed at the periphery of the bottom wall 112 of the casing 110 of the tank 100 in order to cooperate with runners 186 provided in the second casing 182, forming respectively portions of an arc of a circle around the axis of the effluent supply pipe Cn. The shoes 184 that can be seen here attached can however be directly moulded in the shape of the tank during manufacture thereof by a rotary moulding method.

It is thus possible, as suggested by the arrow D, to slightly move the tank 100 in the second casing 182, about the axis of the pipe Cn in order to orient it suitably, that is to say to orient it in order to position the largest sides of the bucket horizontally in order to optimise functioning thereof. A jack 188 is interposed between the tank 100 and the second casing 182 in order to orientate said tank 100 to the most perfect horizontality vis-à-vis the second casing 182. This jack advantageously consists of a nut and screw system.

In FIGS. 13 and 14, the bucket 200 is fixed so as to be articulated between its filling and discharge positions, in a cradle 280. The latter consists of a frame 282 the two lateral sides 284 of which have respectively two housings passing through them, in which the two shafts 210 swivel. The lateral sides are joined by a cross member 286 secured to a pivot 288 articulated on the bottom wall of the tank and, in these FIGS. 13 and 14, in a recess 111 provided in the bottom wall 112. The axis of the pivot is perpendicular to the greatest length of the bucket, that is to say perpendicular to its larger sides. A rod 290 is secured to the frame so as to be able to tilt the bucket laterally in order to place it in a horizontal position. The free end of this rod can be clamped in the opening 116 in the tank 100. In this way it is possible to correct the horizontality of the bucket when the tank is buried. This capability may prove useful when the terrain in which the tank has been buried has moved over time. The bucket 200 can be provided with a level instrument in order to check the horizontality thereof.

In FIG. 14, the presence of two filling openings P1 and P2 can be noted, enabling greater versatility of installation of the vessel on the site according to the configuration of a system of pipes and drains, existing or to be provided. In these FIG. 14, it should be noted that the axis of the filling openings P is parallel to the axis of the emptying openings S.

In FIG. 14*a*, the effluent supply pipe Cn is situated on one side of the tank 100 while in FIG. 14*b* it is situated on the other side, in a corresponding filling opening P1.

The same applies to the bucket 200, which is positioned in FIG. 14*a* in order to discharge into the emptying openings S1, S3 and S5, whereas in FIG. 14*b* it is turned so as to discharge into the other emptying openings S2 and S4. The change to the location of the bucket 200 was obtained by turning over the pivot 288 in the recess 111.

In a variant embodiment, not shown, several effluent supply pipes enter the tank through their respective filling openings in order to fill the bucket.

FIG. 15*a* presents a variant embodiment of a bucket 200' that is provided not with one but with two storage volumes VS1 and VS2 for the effluent. The construction thereof has symmetry passing through a plane secant to the axis of the shaft 210. These two storage volumes, of identical capacity, are disposed symmetrically on either side of an intermediate wall 240' making it possible to discharge alternately on one side and then on the other side of the tank with bucket through corresponding emptying openings. The effluent is discharged into the bucket 200 through the supply pipe Cn or its associated discharge means, which emerges vertically to the shaft 210. The bucket 200' rests through one of its discharge walls 230 on a stop 140.

In FIG. 15*b*, the storage volume VS1 is practically filled, which has moved the centre of gravity G2 past the vertical plane V, so that the bucket 200' tilts towards its other discharge position so that the corresponding discharge wall 230 can come to bear on a second stop 140, as shown by the arrow B. Another filling cycle then begins, which will cause the bucket to tilt towards the first discharge position.

In FIG. 15*c*, the storage volumes VS1' and VS2 have different capacities so that the bucket 200' can discharge a larger quantity of effluent on one side of the tank rather than on the other. Its construction is asymmetric if reference is made to a plane secant to the axis of the shaft 210. A counterweight 242' is placed on the side of the storage volume VS2 with the largest capacity, where applicable, in order to balance the bucket, that is to say so that it can tilt towards a discharge position when the storage volume is almost full.

This bucket with two storage volumes is preferably suitable for being installed in a symmetrical tank, that is to say a tank provided with a number of emptying openings identical on each side of it.

Moreover, the functioning of the bucket being symmetrical, it is not necessary to provide another location for the guidance bearings of the shafts of the bucket in order to reverse the position thereof, except for the variant with different capacities.

In FIG. 15*d*, a mask 124 is disposed in one of the storage volumes and here the volume VS2 in order to simulate the functioning of a unidirectional bucket with a bidirectional bucket.

FIG. 16 presents a tank in section incorporating a bucket with bidirectional discharge.

FIG. 17 presents a plan view in section of a tank 100 incorporating a bucket with bidirectional discharge 200'. A mask 124 is placed in the bucket opposite the corresponding emptying opening S5. Three emptying openings pass through the casing 110 on each side. The emptying openings situated on the same side are grouped together in order to collect the effluent through a common pipe, as suggested by the arrows F1 and F2.

The presence of two effluent supply pipes Cn, only one of which can be activated, for example the pipe Cn1, should also be noted.

FIG. 18 presents a view in transverse section of a tank 100 incorporating a bucket with bidirectional discharge 200'. The bucket 200 can, there also, be provided with a level instrument for checking the horizontality thereof.

In FIG. 19, various tanks with bucket 100 are connected together. Thus a distribution tank situated on the left of this figure can be seen, which supplies in parallel three distribution tanks, situated on the right of the figure, thus making it possible to discharge an effluent into multiple emptying openings S'. The number of tanks connected per level is dependent generally on the flow rate of the effluent. A number of levels greater than two may be necessary. It is also possible to use other distribution systems in replacement for this distribution tank.

The tank of the invention can be equipped with accessories. A flow-rate sensor can thus be located on the effluent supply pipe in order to know the quantity of effluent distributed by the tank. It can be equipped with a system for injecting additives into the tank. In a variant embodiment, a meter may be installed on the bucket in order to count the number of tilting cycles thereof in order to determine, taking account of the volume of the bucket, the quantity of effluent distributed by the tank.

It can also be provided with a takeoff system intended to take off effluent samples at regular intervals and then to transfer them into a storage unit for the purpose of carrying out analyses on these samples.

In FIG. 20, the tank with bucket 100 is integrated in or associated with the construction of a septic tank T making it possible, in the same installation, to treat the effluent and then to distribute it. The tank with bucket 100 is shown, up against the outside of the septic tank T. It may, in one embodiment, not shown, be placed inside it. Moreover, the tank with bucket 100 can also be integrated in or associated with the construction of a tank such as a rainwater collection tank.

In order to improve further the versatility of distribution of the tank with bucket, passages 122 connect, in FIG. 21, the vessels 120 communicating with the emptying openings S1, S3 and S5 situated on the same side with the vessels communicating with the emptying openings S2 and S4 situated on the opposite side so that the bucket can discharge its content through all the emptying openings that are open, that is to say that are not closed by an obturator. It is thus possible to more easily irrigate the soil or other devices on either side of the tank.

A mask 124 is moreover disposed laterally in the bucket 200, which is here of the unilateral discharge type. Two obturators O close off the corresponding emptying openings S1 and S2 disposed opposite the mask 124.

In an embodiment that is not shown, the width of the bucket is reduced from one side, by an amount equal to the width of a mask, so that the presence of such a mask is no longer necessary in the bucket in order to prevent its discharging the content thereof in the direction of a closed-off emptying opening or openings.

FIG. 22 present different examples of configuration of the tank with bucket of the invention in order to show its great versatility.

Figure 22A:
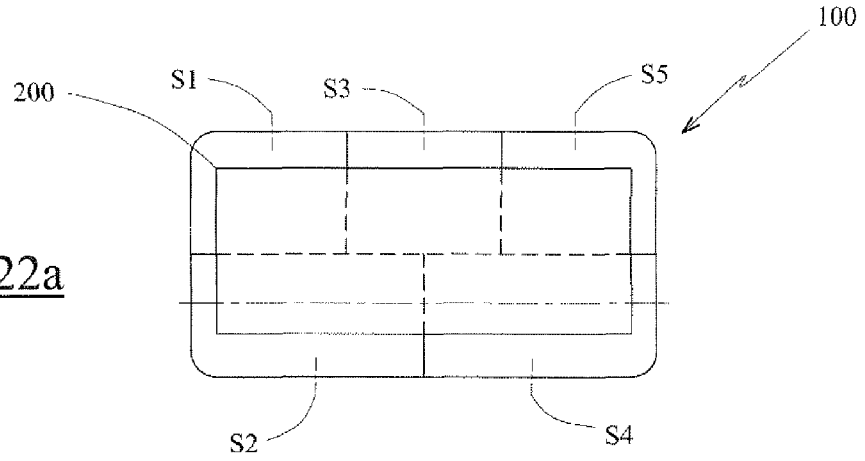

The tank 100 presented in FIG. 22*a* is provided with emptying openings S distributed on two sides and its bucket 200 is of the unidirectional discharge type. The number of emptying openings S is different on the two sides. By reversing the direction of the bucket 200, the effluent discharge side is changed. By closing off an emptying opening S1, S3 or S5, a symmetrical tank is obtained, that is to say with a number of emptying openings S identical for each of the sides thereof. It is also possible to place one or more masks in the bucket opposite the corresponding emptying openings that are closed off.

Figure 22B:
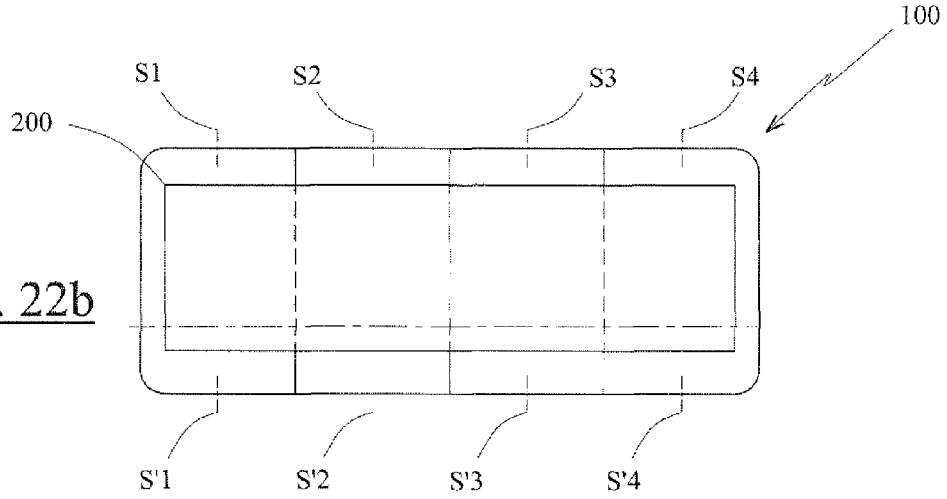

The tank 100 presented in FIG. 22*b* is provided with emptying openings distributed on two sides and its bucket 200 is of the unidirectional discharge type. The number of emptying openings S is identical on the two sides. The emptying openings S situated opposite each other communicate. During functioning thereof, the tank distributes the effluent over all the emptying openings S. It is possible, here also, to place a mask in the bucket opposite an emptying opening that is closed off.

Figure 22C:
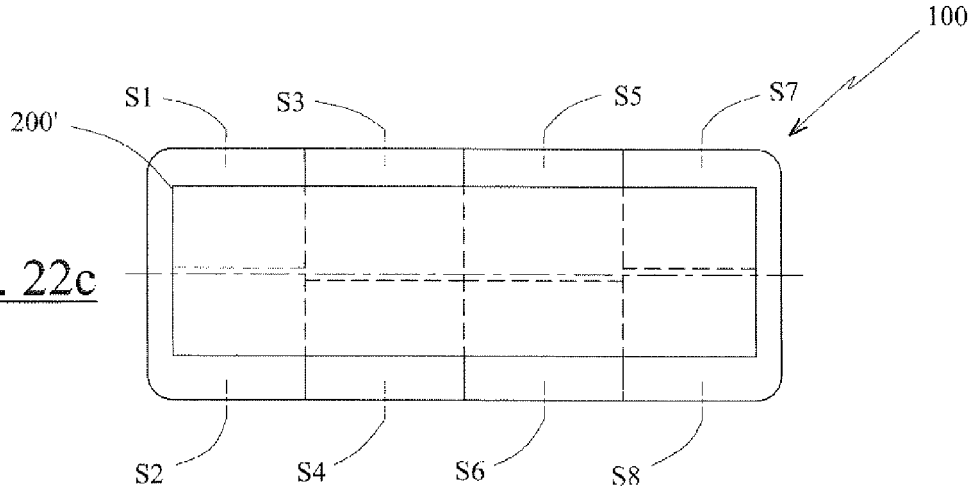

The tank 100 presented in FIG. 22*c* is provided with emptying openings S distributed on two sides and its bucket 200' is of the bidirectional discharge type. The number of emptying openings S is identical or not on the two sides. During functioning thereof, the tank distributes the effluent discharged alternately on one side and the other.

Figure 22D:
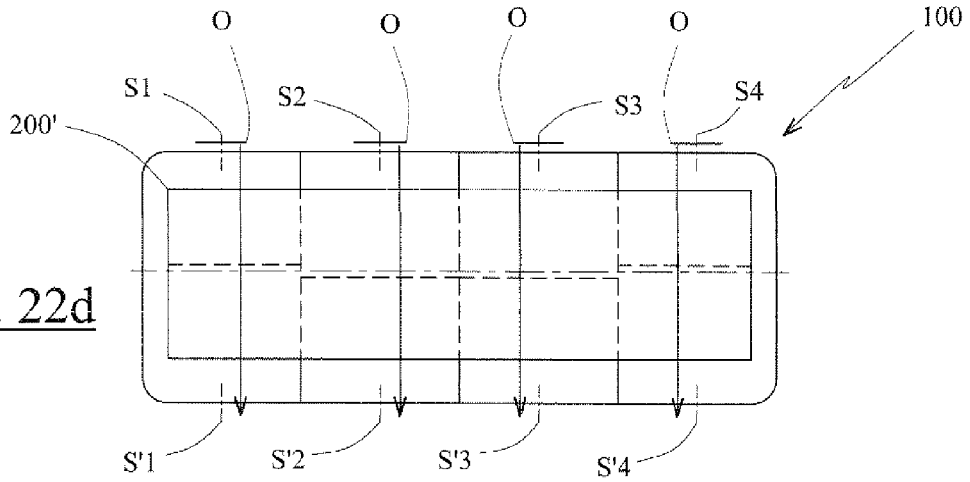

The tank 100 presented in FIG. 22*d* is provided with emptying openings S distributed on two sides and its bucket 200' is of the bidirectional discharge type. The number of emptying openings S is preferentially identical on the two sides, as is seen in this FIG. 22*d*. The emptying openings in a row are closed by obturators O. Whatever the discharge side of the bucket, the effluent always emerges on the same side of the tank through available emptying openings. It is thus possible to choose the number of operational emptying openings.

Figure 22E:
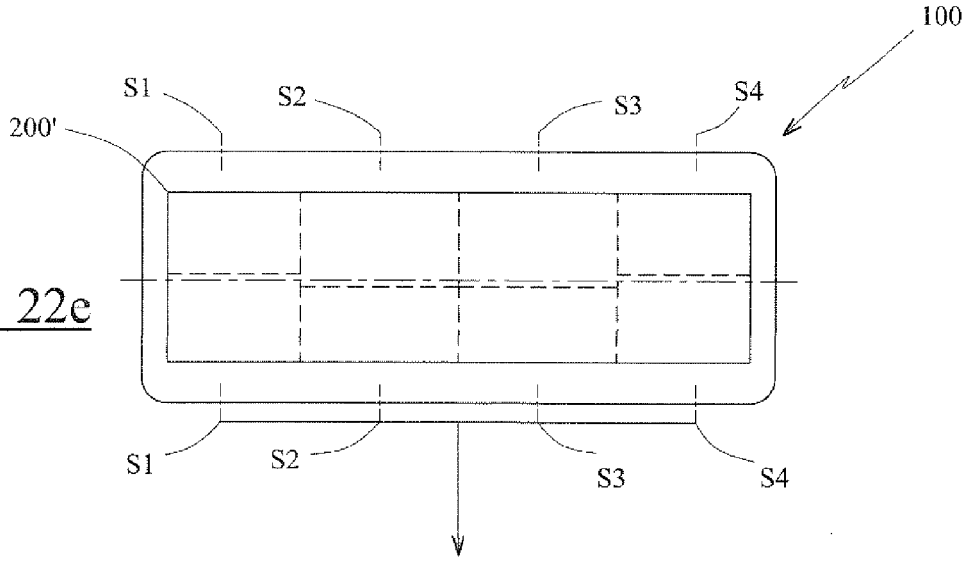

In FIG. 22*e*, at least two emptying openings situated on the same side are connected to a manifold in order to discharge a larger quantity of effluent, through drains and pipes, to another use.

Figure 22F:
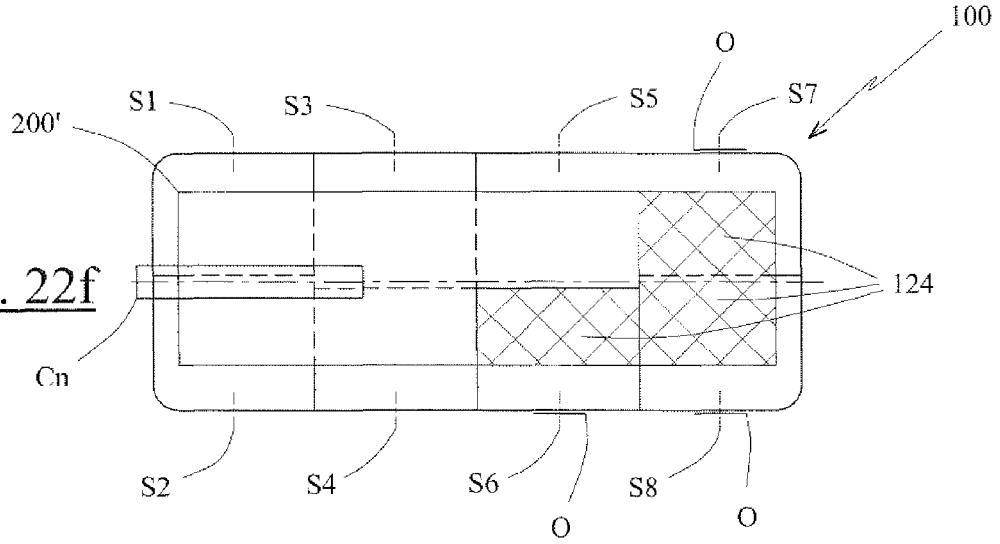

In FIG. 22*f*, the presence of masks 124 is noted in some storage volumes of the bucket 200', which is in this figure of the bidirectional discharge type, and obturators O close off the emptying openings disposed opposite, so that the effluent can be distributed through open emptying openings in a distributed manner.

Figure 22G:
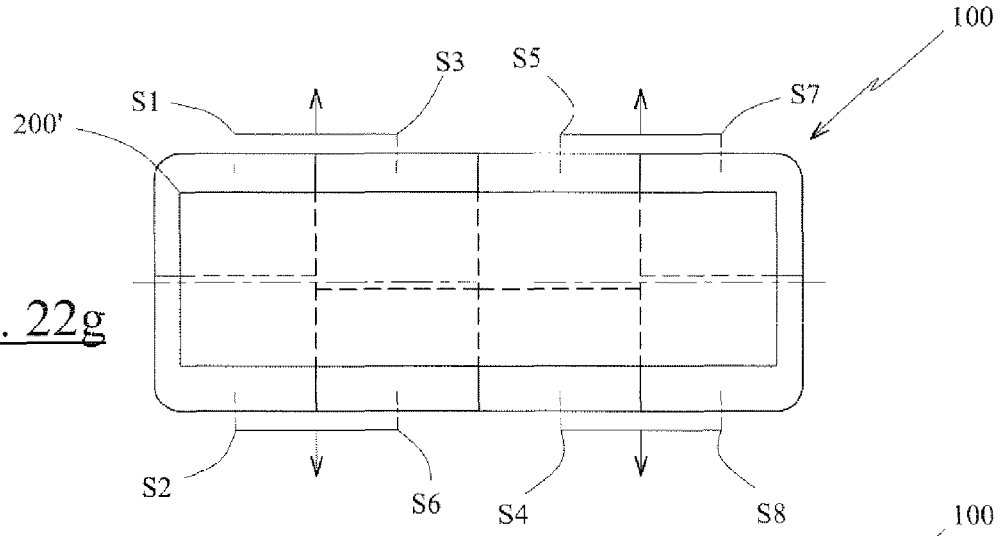

In FIG. 22*g*, emptying openings are grouped together so that the effluent can flow through common pipes. In this FIG. 22*g*, all the emptying openings are grouped in pairs.

Figure 22H:
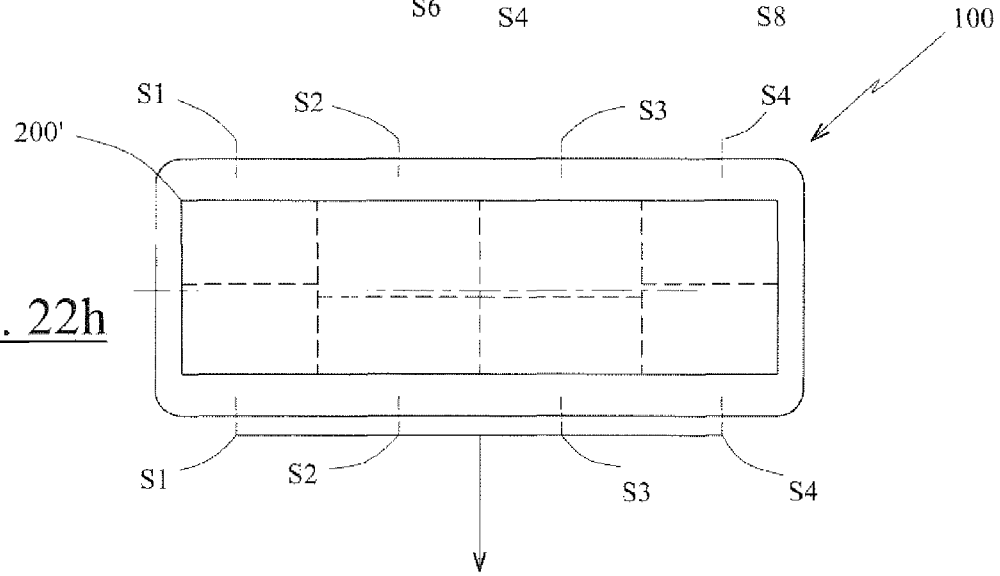

In FIG. 22*h*, all the emptying openings situated on the same side are grouped together in a common pipe.

Figure 22I:
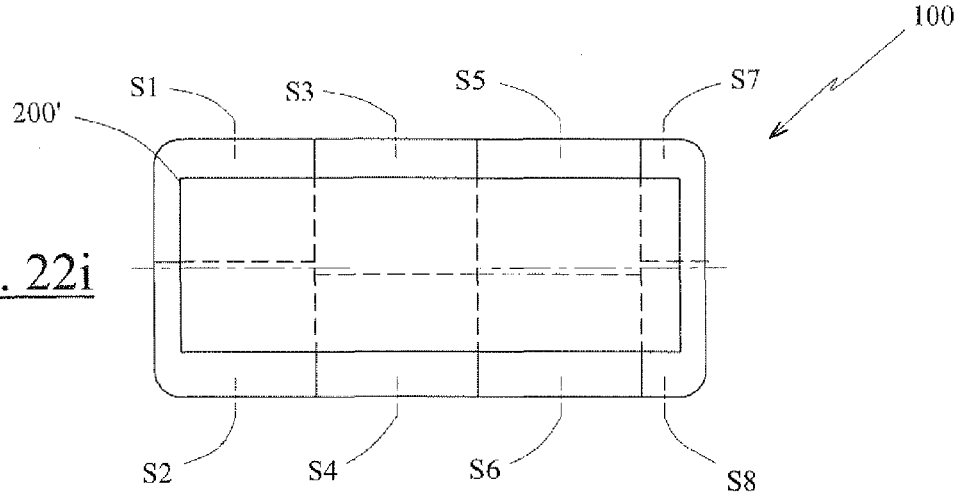

In FIG. 22*i*, the tank 100 incorporates a bucket 200' of the bidirectional discharge type as well as a takeoff system suitable for taking off a quantity of sample that is proportional to the flow rate. The bucket for this purpose is provided with two storage volumes, disposed facing each other, the capacity of which is clearly reduced, as can be seen in this FIG. 22*i*. The volumes of the corresponding effluent reception vessels are reduced accordingly. A small quantity of effluent is then sent alternately through corresponding emptying openings S7 and S8.

Figure 22J:
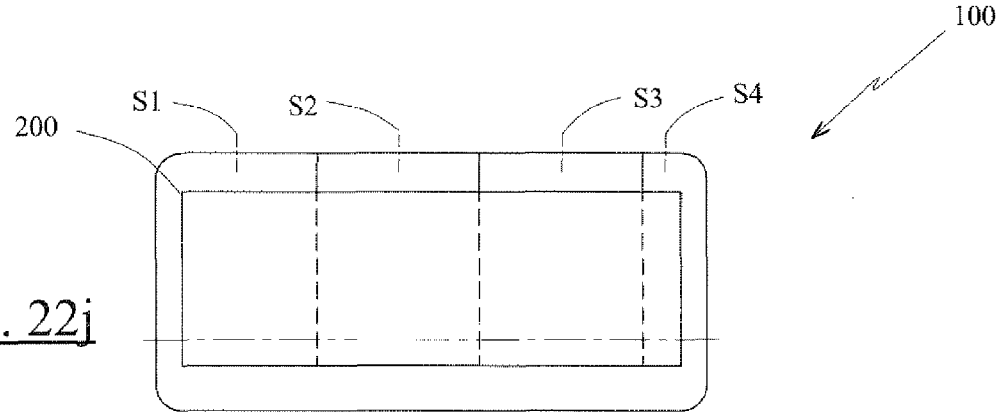

In FIG. 22*j*, the tank 100 incorporates a bucket 200 of the unidirectional discharge type and a takeoff system suitable for taking off a quantity of sample that is proportional to the flow rate. The bucket is provided for this purpose with a storage volume the capacity of which is clearly reduced, as is clear in this FIG. 22*j*. A small quantity of effluent is then sent through the corresponding emptying opening S4 during the emptying of the bucket 200.

Figure 22K:
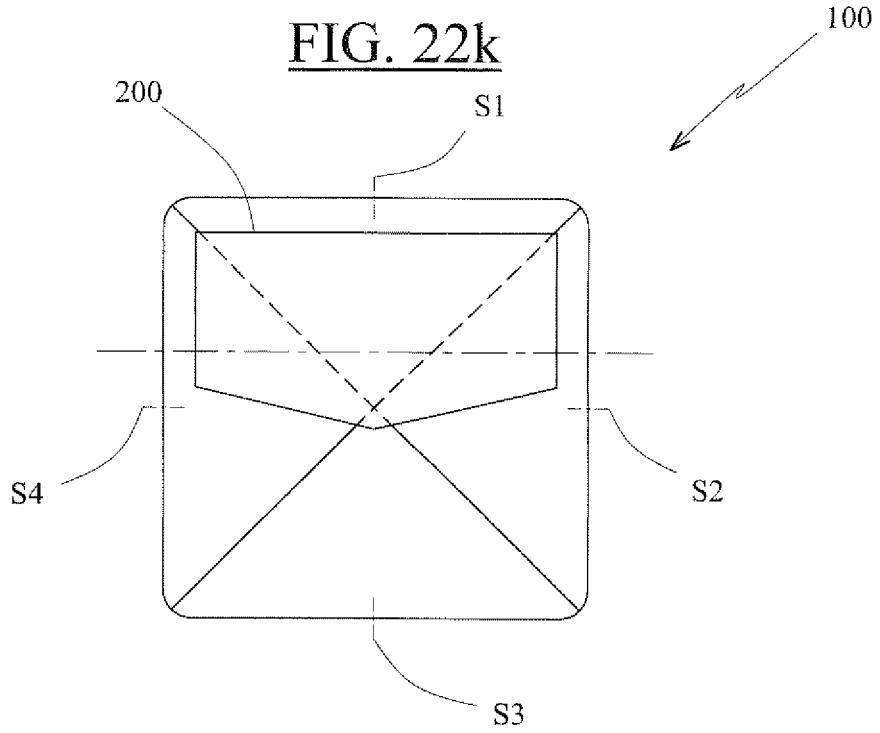

The tank 100 presented in FIG. 22*k* is provided with emptying openings S distributed over four sides and its bucket 200 is of the asymmetric type. The number of emptying openings S is identical or not on the sides. By changing the location of the bucket 200, the effluent discharge side is changed.

Figure 22L:
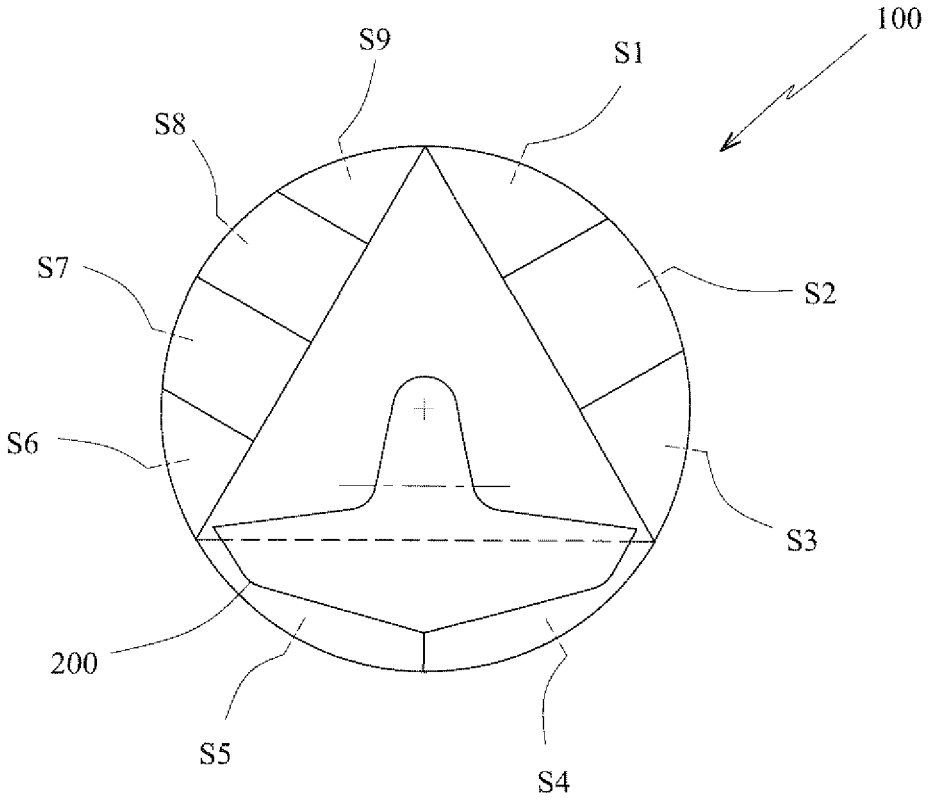

The tank 100 presented in FIG. 22*l* is provided with emptying openings S distributed over three sides and its bucket 200 is of the asymmetric type. The number of emptying openings S is identical or not on the three sides. By changing the location of the bucket 200 the effluent discharge side is changed.

These different example embodiments of the tank with bucket of the invention show its versatility in use, enabling it to respond to a great diversity of uses. It makes it possible in particular to anticipate the change in requirements of effluent treatment on a site.

The invention claimed is:

1. Tank provided with at least one effluent filling opening and at least two effluent emptying openings, and a bucket mounted so as to tilt between a filling position in which the bucket can be filled with an effluent entering through said or each filling opening and a discharge position in which the contents thereof can be discharged through said or each emptying opening, characterised in that the tank comprises means designed to modify the location of the bucket so as to change the direction of discharge thereof or to enable it to be replaced by another bucket of a different type, wherein at least one mask is placed in the bucket opposite a corresponding emptying opening closed by an obturator (O) in order to keep a distribution distributed in a balanced manner between the other emptying openings.

2. Tank according to claim 1, characterised in that it comprises a casing and in that the bucket is mounted articulated in the casing, by means of two shafts held in respectively two bearings secured to said casing, the bearings being removable or sufficient in number to modify the location of the bucket or for replacement thereof.

3. Tank according to claim 2, characterised in that each bearing is secured by bolts passing through holes produced through a bottom wall constituting the casing, the holes delimiting the locations in which said bearings are placed.

4. Tank according to claim 3, characterised in that at least one stop is disposed in the bottom wall for limiting the tilting of the bucket into its filling position or positions.

5. Tank according to claim 3, characterised in that the bucket is fixed so as to be articulated, between its filling and discharge positions, in a cradle provided with a pivot mounted on the bottom wall in an articulated manner in order to be able to adjust the horizontality of said bucket.

6. Tank according to claim 3, characterised in that the emptying openings (S) are at the same level and are provided on at least two sides of the belt wall of the tank and in that the bucket has at least two distinct locations.

7. Tank according to claim 2, characterised in that the bucket is a bilateral discharge bucket and comprises two volumes (VS1 and VS2) for storing the effluent disposed on either side of an intermediate wall, the bucket being able to move alternately between two discharge positions, the position of filling one storage volume also being a discharge position for the other storage volume, the centre of gravity (G1, G2) of the bucket being placed so that it can, during the filling of a storage volume (VS1 or VS2), pass through a vertical plane (V) passing through the articulation axis of the bucket so as to tilt it towards its other discharge position.

8. Tank according to claim 7, characterised in that the two storage volumes (VS1' and VS2) have different capacities in order to discharge a larger quantity of effluent on one side of the tank rather than on the other.

9. Tank according to claim 1, characterised in that the bucket is a unilateral discharge bucket and comprises an effluent storage volume (VS) and a counterweight, the bucket being able to move between a filling position and a discharge position, the storage volume (VS) and the counterweight being arranged so that the centre of gravity (G1, G2) of the bucket can, during the filling of the storage volume (VS), pass through a vertical plane (V) passing through the articulation axis of the bucket so as to tilt it towards its discharge position.

10. Tank according to claim 1, characterised in that the emptying openings (S) emerge respectively in vessels formed recessed in the bottom wall of the casing.

11. Tank according to claim 10, characterised in that passages connect the vessels communicating with the emptying openings (S1, S3, S5) situated on the same side, with the vessels communicating with the emptying openings (S2, S4) situated on the opposite side, so that the bucket can discharge its content through all the emptying openings that are open.

12. Tank according to claim 10, characterised in that a wall forming a barrage separates the bottom wall between two rows of emptying openings in order to contain the discharged effluent so that it flows solely into the vessels in the row situated on the discharge side of the bucket.

13. Tank according to claim 1, characterised in that the width of the bucket is reduced in order to prevent its discharging its content in the direction of a closed-off emptying opening or openings.

14. Tank according to claim 1, characterised in that a flowrate sensor is located on an effluent supply pipe (Cn) intended to be mounted through the filling opening (P), or a meter is installed on the bucket in order to know or calculate the quantity of effluent distributed by the tank.

15. Tank according to claim 1, characterised in that it is provided with a takeoff system intended to take off effluent at regular intervals.

16. Tank according to claim 1, characterised in that it is integrated in or associated with the construction of a septic tank (S) or of a tank for treating the effluent in the same installation and then distributing it.

17. Tank according to claim 1, characterised in that the tank or bucket is provided with a level instrument intended to check the horizontal positioning of said tank or said bucket, in order to correct it where necessary.

18. Tank according to claim 17, characterised in that the level instrument is a spirit level, housed in a cell produced on the rim of a casing of the tank.

19. Tank according to claim 18, characterised in that it is provided with a means of discharging effluent in the bucket in order to obtain reproducible functioning thereof.

20. Tank according to claim 19, characterised in that the discharge means comprises a sleeve connected to an effluent supply pipe (Cn), the sleeve, which is otherwise closed, having a plurality of holes passing through its lower part, or its part intended to be turned towards the bucket, in order to direct the flow of effluent in the direction of the bucket.

21. Tank according to claim 20, characterised in that the effluent supply pipe (Cn) and/or the sleeve has a ventilation opening passing through it in its top part in order to balance the pressure in a closed installation.

22. Tank according to claim 1, characterised in that it is enclosed in a second casing intended to be buried and being housed therein so as to be able to modify its relative position with respect to the second casing.

23. Tank according to claim 1, characterised in that a manifold connects at least two emptying openings (S).

24. Tank provided with at least one effluent filling opening and at least two effluent emptying openings, and a bucket mounted so as to tilt between a filling position in which it can be filled with an effluent entering through said or each filling opening and a discharge position in which it can discharge its content through said or each emptying opening, characterised in that the tank comprises means designed to modify the location of the bucket so as to change the direction of discharge thereof or to enable it to be replaced by another bucket of a different type, wherein the tank is enclosed in a second casing intended to be buried and being housed therein so as to be able to modify its relative position with respect to the second casing, wherein shoes are provided at the periphery of the bottom wall of the tank in order to cooperate with runners provided in the second casing forming respectively portions of an arc of a circle around the axis of an effluent supply pipe (Cn) passing through an effluent filling opening.

25. Tank according to claim 24 wherein a jack is interposed between the tank and the second casing in order to adjust the horizontal position of the tank vis-à-vis the second casing.

* * * * *